US008965773B2

(12) United States Patent
Kovesi et al.

(10) Patent No.: US 8,965,773 B2
(45) Date of Patent: Feb. 24, 2015

(54) CODING WITH NOISE SHAPING IN A HIERARCHICAL CODER

(75) Inventors: Balazs Kovesi, Lannion (FR); Stéphane Ragot, Lannion (FR); Alain Le Guyader, Lannion (FR)

(73) Assignee: Orange, Paris (FR)

( * ) Notice: Subject to any disclaimer, the term of this patent is extended or adjusted under 35 U.S.C. 154(b) by 844 days.

(21) Appl. No.: 13/129,483

(22) PCT Filed: Nov. 17, 2009

(86) PCT No.: PCT/FR2009/052194

§ 371 (c)(1),
(2), (4) Date: May 16, 2011

(87) PCT Pub. No.: WO2010/058117

PCT Pub. Date: May 27, 2010

(65) Prior Publication Data

US 2011/0224995 A1 Sep. 15, 2011

(30) Foreign Application Priority Data

Nov. 18, 2008 (FR) ..... 08 57839

(51) Int. Cl.
*G10L 19/00* (2013.01)
*G10L 19/24* (2013.01)
(Continued)

(52) U.S. Cl.
CPC ..... *G10L 19/24* (2013.01); *G10L 19/265* (2013.01); *G10L 19/04* (2013.01)
USPC ..... 704/500; 341/94; 370/352; 375/243; 382/100; 704/205; 704/207; 704/214; 704/219; 704/221; 704/222; 704/223; 704/224; 704/230; 704/233; 704/258; 704/503; 714/701

(58) Field of Classification Search
CPC ..... G10L 19/008; G10L 19/24; G10L 19/167; G10L 21/038; G10L 20/10527; G11B 20/10527
USPC ..... 704/500
See application file for complete search history.

(56) References Cited

U.S. PATENT DOCUMENTS 3,688,097 A * 8/1972 Montgomery ..... 708/208
4,386,237 A * 5/1983 Virupaksha et al. ..... 704/224

(Continued)

OTHER PUBLICATIONS

Fuchs, Guillaume, and Roch Lefebvre. "A scalable CELP/transform coder for low bit Rate speech and audio coding." Audio Engineering Society Convention 120. Audio Engineering Society, 2006.*

(Continued)

*Primary Examiner* — Pierre-Louis Desir
*Assistant Examiner* — Fariba Sirjani
(74) *Attorney, Agent, or Firm* — Drinker Biddle & Reath LLP

(57) ABSTRACT

A method is provided for hierarchical coding of a digital audio signal comprising, for a current frame of the input signal: a core coding, delivering a scalar quantization index for each sample of the current frame and at least one enhancement coding delivering indices of scalar quantization for each coded sample of an enhancement signal. The enhancement coding comprises a step of obtaining a filter for shaping the coding noise used to determine a target signal and in that the indices of scalar quantization of said enhancement signal are determined by minimizing the error between a set of possible values of scalar quantization and said target signal. The coding method can also comprise a shaping of the coding noise for the core bitrate coding. A coder implementing the coding method is also provided.

21 Claims, 16 Drawing Sheets

(51) Int. Cl.
*G10L 19/26* (2013.01)
*G10L 19/04* (2013.01)

(56) References Cited

U.S. PATENT DOCUMENTS

| | | | | |
|---|---|---|---|---|
| 4,633,483 | A * | 12/1986 | Takahashi et al. | 375/244 |
| 5,068,899 | A * | 11/1991 | Ellis et al. | 704/212 |
| 5,819,212 | A * | 10/1998 | Matsumoto et al. | 704/219 |
| 6,243,672 | B1 * | 6/2001 | Iijima et al. | 704/207 |
| 6,292,777 | B1 * | 9/2001 | Inoue et al. | 704/230 |
| 6,349,284 | B1 * | 2/2002 | Park et al. | 704/500 |
| 6,504,838 | B1 * | 1/2003 | Kwan | 370/352 |
| 6,614,370 | B2 * | 9/2003 | Gottesman | 341/94 |
| 6,650,762 | B2 * | 11/2003 | Gibson et al. | 382/100 |
| 6,735,567 | B2 * | 5/2004 | Gao et al. | 704/258 |
| 6,782,367 | B2 * | 8/2004 | Vainio et al. | 704/500 |
| 6,829,579 | B2 * | 12/2004 | Jabri et al. | 704/221 |
| 7,009,935 | B2 * | 3/2006 | Abrahamsson et al. | 370/228 |
| 7,142,604 | B2 * | 11/2006 | De Lameillieure | 375/240.26 |
| 7,161,931 | B1 * | 1/2007 | Li et al. | 370/352 |
| 7,184,953 | B2 * | 2/2007 | Jabri et al. | 704/221 |
| 7,266,493 | B2 * | 9/2007 | Su et al. | 704/207 |
| 7,272,567 | B2 * | 9/2007 | Fejzo | 704/500 |
| 7,330,812 | B2 * | 2/2008 | Ding | 704/200.1 |
| 7,362,811 | B2 * | 4/2008 | Dunne et al. | 375/241 |
| 7,408,918 | B1 * | 8/2008 | Ramalho | 370/351 |
| 7,423,983 | B1 * | 9/2008 | Li et al. | 370/280 |
| 7,454,330 | B1 * | 11/2008 | Nishiguchi et al. | 704/224 |
| 7,478,042 | B2 * | 1/2009 | Ehara et al. | 704/233 |
| 7,490,036 | B2 * | 2/2009 | Jasiuk et al. | 704/219 |
| 7,580,834 | B2 * | 8/2009 | Ehara et al. | 704/221 |
| 7,702,504 | B2 * | 4/2010 | Son et al. | 704/219 |
| 7,725,312 | B2 * | 5/2010 | Jabri et al. | 704/221 |
| 7,729,905 | B2 * | 6/2010 | Sato et al. | 704/219 |
| 7,801,733 | B2 * | 9/2010 | Lee et al. | 704/500 |
| 7,895,046 | B2 * | 2/2011 | Andersen et al. | 704/503 |
| 7,921,009 | B2 * | 4/2011 | Dai | 704/223 |
| 7,933,227 | B2 * | 4/2011 | Li et al. | 370/278 |
| 7,933,770 | B2 * | 4/2011 | Kruger et al. | 704/222 |
| 7,979,271 | B2 * | 7/2011 | Bessette | 704/219 |
| 7,991,611 | B2 * | 8/2011 | Ehara et al. | 704/205 |
| 8,036,390 | B2 * | 10/2011 | Goto et al. | 381/17 |
| 8,102,872 | B2 * | 1/2012 | Spindola et al. | 370/450 |
| 8,150,682 | B2 * | 4/2012 | Nongpiur et al. | 704/207 |
| 8,170,879 | B2 * | 5/2012 | Nongpiur et al. | 704/268 |
| 8,199,835 | B2 * | 6/2012 | Amini et al. | 375/243 |
| 8,254,404 | B2 * | 8/2012 | Rabenko et al. | 370/429 |
| 8,271,273 | B2 * | 9/2012 | Gao | 704/219 |
| 8,352,250 | B2 * | 1/2013 | Vos et al. | 704/205 |
| 8,446,947 | B2 * | 5/2013 | Yu et al. | 375/240.03 |
| 8,452,606 | B2 * | 5/2013 | Vos et al. | 704/500 |
| 8,484,019 | B2 * | 7/2013 | Hedelin et al. | 704/219 |
| 8,498,875 | B2 * | 7/2013 | Sung et al. | 704/500 |
| 8,515,767 | B2 * | 8/2013 | Reznik | 704/500 |
| 8,577,687 | B2 * | 11/2013 | Kovesi et al. | 704/500 |
| 8,595,000 | B2 * | 11/2013 | Lee et al. | 704/219 |
| 8,620,647 | B2 * | 12/2013 | Gao et al. | 704/214 |
| 8,645,146 | B2 * | 2/2014 | Koishida et al. | 704/500 |
| 8,706,506 | B2 * | 4/2014 | Okazaki | 704/500 |
| 8,706,507 | B2 * | 4/2014 | Vinton | 704/500 |
| 2001/0044712 | A1 * | 11/2001 | Vainio et al. | 704/201 |
| 2003/0177004 | A1 * | 9/2003 | Jabri et al. | 704/219 |
| 2004/0208169 | A1 * | 10/2004 | Reznik | 370/352 |
| 2005/0027517 | A1 * | 2/2005 | Jabri et al. | 704/219 |
| 2005/0114123 | A1 * | 5/2005 | Lukac et al. | 704/222 |
| 2006/0171419 | A1 * | 8/2006 | Spindola et al. | 370/477 |
| 2006/0206316 | A1 * | 9/2006 | Sung et al. | 704/207 |
| 2007/0147518 | A1 * | 6/2007 | Bessette | 375/243 |
| 2008/0015852 | A1 * | 1/2008 | Kruger et al. | 704/225 |
| 2008/0077401 | A1 * | 3/2008 | Jabri et al. | 704/219 |
| 2009/0076830 | A1 * | 3/2009 | Taleb | 704/500 |
| 2009/0254783 | A1 * | 10/2009 | Hirschfeld et al. | 714/701 |
| 2010/0145712 | A1 * | 6/2010 | Kovesi et al. | 704/500 |
| 2010/0191538 | A1 * | 7/2010 | Kovesi et al. | 704/500 |
| 2011/0035226 | A1 * | 2/2011 | Mehrotra et al. | 704/500 |
| 2011/0173004 | A1 * | 7/2011 | Bessette et al. | 704/500 |
| 2011/0202354 | A1 * | 8/2011 | Grill et al. | 704/500 |
| 2011/0202355 | A1 * | 8/2011 | Grill et al. | 704/500 |
| 2011/0224995 | A1 * | 9/2011 | Kovesi et al. | 704/500 |
| 2012/0101814 | A1 * | 4/2012 | Elias | 704/207 |
| 2013/0051579 | A1 * | 2/2013 | Craven et al. | 381/98 |
| 2013/0204630 | A1 * | 8/2013 | Ragot et al. | 704/500 |
| 2013/0268268 | A1 * | 10/2013 | Kovesi et al. | 704/230 |

OTHER PUBLICATIONS

"G.711.1: A wideband extension to ITU-T G.711". Y. Hiwasaki, S. Sasaki, H. Ohmuro, T. Mori, J. Seong, M. S. Lee, B. Kovesi, S. Ragot, J.-L. Garcia, C. Marro, L. M., J. Xu, V. Malenovsky, J. Lapierre, R. Lefebvre, EUSIPCO, Lausanne, 2008.*

"Wideband speech coding robust against package loss," Takeshi Mori, Hitoshi Ohmuro, Yusuke Hiwasaki, Sachiko Kurihara, Akitoshi Kataoka, Electronics and Communications in Japan, vol. 89, Issue 12, pp. 20-30, Dec. 2006.*

* cited by examiner

CODING WITH NOISE SHAPING IN A HIERARCHICAL CODER

CROSS-REFERENCE-TO RELATED APPLICATIONS

This application is a U.S. national phase of the International Patent Application No. PCT/FR2009/052194 filed Nov. 17, 2009, which claims the benefit of French Application No. 08 57839 filed Nov. 18, 2008, the entire content of which is incorporated herein by reference.

FIELD OF THE INVENTION

The present invention relates to the field of the coding of digital signals.

BACKGROUND

The coding according to the invention is adapted especially for the transmission and/or storage of digital signals such as audiofrequency signals (speech, music or other).

The present invention pertains more particularly to waveform coding of ADPCM (for "Adaptive Differential Pulse Code Modulation") coding type and especially to coding of ADPCM type with embedded codes making it possible to deliver quantization indices with scalable binary train.

The general principle of embedded-codes ADPCM coding/decoding specified by recommendation ITU-T G.722 or ITU-T G.727 is such as described with reference to FIGS. 1 and 2.

FIG. 1 thus represents an embedded-codes coder of ADPCM type.

It comprises:

- a prediction module 110 making it possible to give the prediction of the signal $x_P^B(n)$ on the basis of the previous samples of the quantized error signal $e_Q^B(n')=y_{I^B}^B(n')v(n')n'=n-1, \ldots, n-N_Z$, where $v(n')$ is the scale factor, and of the reconstructed signal $r^B(n')n'=n-1, \ldots, n-N_P$ where n is the current instant.
- a subtraction module 120 which deducts from the input signal x(n) its prediction $x_P^B(n)$ to obtain a prediction error signal denoted e(n).
- a quantization module 130 $Q^{B+K}$ for the error signal which receives as input the error signal e(n) so as to give quantization indices $I^{B+K}(n)$ consisting of B+K bits. The quantization module $Q^{B+K}$ is of the embedded-codes type, that is to say it comprises a core quantizer with B bits and quantizers with B+k k=1, . . . , K bits which are embedded on the core quantizer.

In the case of the ITU-T G.722 standard, the decision levels and the reconstruction levels of the quantizers $Q^B$, $Q^{B+1}$, $Q^{B+2}$ for B=4 are defined by tables IV and VI of the overview article describing the G.722 standard by X. Maitre. "7 kHz audio coding within 64 kbit/s", IEEE Journal on Selected Areas in Communication, Vol. 6-2, February 1988.

The quantization index $I^{B+K}(n)$ of B+K bits at the output of the quantization module $Q^{B+K}$ transmitted via the transmission channel 140 to the decoder such as described with reference to FIG. 2.

The coder also comprises:

- a module 150 for deleting the K low-order bits of the index $I^{B+K}(n)$ so as to give a low bitrate index $I^B(n)$;
- an inverse quantization module 160 $(Q^B)^{-1}$ to give as output a quantized error signal $e_Q^B(n)=y_{I^B}^B(n)v(n)$ on B bits;
- an adaptation module 170 $Q_{Adapt}$ for the quantizers and inverse quantizers to give a level control parameter v(n) also called scale factor, for the following instant;

- an addition module 180 for adding the prediction $x_P^B(n)$ to the quantized error signal to give the low bitrate reconstructed signal $r^B(n)$;
- an adaptation module 190 $P_{Adapt}$ for the prediction module based on the quantized error signal on B bits $e_Q^B(n)$ and on the signal $e_Q^B(n)$ filtered by $1+P_z(z)$.

It may be observed that in FIG. 1 the dotted part referenced 155 represents the low bitrate local decoder which contains the predictors 165 and 175 and the inverse quantizer 160. This local decoder thus makes it possible to adapt the inverse quantizer at 170 on the basis of the low bitrate index $I^B(n)$ and to adapt the predictors 165 and 175 on the basis of the reconstructed low bitrate data.

This part is found identically in the embedded-codes ADPCM decoder such as described with reference to FIG. 2.

The embedded-codes ADPCM decoder of FIG. 2 receives as input the indices $I'^{B+K}$ arising from the transmission channel 140, a version of $I^{B+K}$ that may possibly be disturbed by binary errors, and carries out an inverse quantization by the inverse quantization module 210 $(Q^B)^{-1}$ of bitrate B bits per sample to obtain the signal $e'^B_Q(n)=y'^B_{I^B}(n)v'(n)$. The symbol "'" indicates a value received at the decoder which may possibly differ from that transmitted by the coder on account of transmission errors.

The output signal $r'^B(n)$ for B bits will be equal to the sum of the prediction of the signal and of the output of the inverse quantizer with B bits. This part 255 of the decoder is identical to the low bitrate local decoder 155 of FIG. 1.

Employing the bitrate indicator mode and the selector 220, the decoder can enhance the signal restored.

Indeed if mode indicates that B+1 bits have been transmitted, the output will be equal to the sum of the prediction $x_P^B(n)$ and of the output of the inverse quantizer 230 with B+1 bits $y'^{B+1}_{I^{B+1}}(n)v'(n)$.

If mode indicates that B+2 bits have been transmitted, then the output will be equal to the sum of the prediction $x_P^B(n)$ and of the output of the inverse quantizer 240 with B+2 bits $y'^{B+2}_{I^{B+2}}(n)v'(n)$.

By using the z-transform notation, the following may be written for this looped structure:

$$R^{B+k}(z)=X(Z)+Q^{B+k}(z)$$

by defining the quantization noise with B+k bits $Q^{B+k}(z)$ by:

$$Q^{B+k}(z)=E_Q^{B+k}(z)-E(z)$$

The embedded-codes ADPCM coding of the ITU-T G.722 standard (hereinafter named G.722) carries out a coding of the signals in broadband which are defined with a minimum bandwidth of [50-7000 Hz] and sampled at 16 kHz. The G.722 coding is an ADPCM coding of each of the two subbands of the signal [50-4000 Hz] and [4000-7000 Hz] obtained by decomposition of the signal by quadrature mirror filters. The low band is coded by embedded-codes ADPCM coding on 6, 5 and 4 bits while the high band is coded by an ADPCM coder of 2 bits per sample. The total bitrate will be 64, 56 or 48 bit/s according to the number of bits used for decoding the low band.

This coding was first used in ISDN (Integrated Services Digital Network) and then in applications of audio coding on IP networks.

By way of example, in the G.722 standard, the 8 bits are apportioned in the following manner such as represented in FIG. 3:

2 bits $I_{h1}$ and $I_{h2}$ for the high band 6 bits $I_{L1}$ $I_{L2}$ $I_{L3}$ $I_{L4}$ $I_{L5}$ $I_{L6}$ for the low band.

Bits $I_{L5}$ and $I_{L6}$ may be "stolen" or replaced with data and constitute the low band enhancement bits. Bits $I_{L1}$ $I_{L2}$ $I_{L3}$ $I_{L4}$ constitute the low band core bits.

Thus, a frame of a signal quantized according to the G.722 standard consists of quantization indices coded on 8, 7 or 6 bits. The frequency of transmission of the index being 8 kHz, the bitrate will be 64, 56 or 48 kbit/s.

For a quantizer with a large number of levels, the spectrum of the quantization noise will be relatively flat as shown by FIG. 4. The spectrum of the signal is also represented in FIG. 4 (here a voiced signal block). This spectrum has a large dynamic swing (~40 dB). It may be seen that in the low-energy zones, the noise is very close to the signal and is therefore no longer necessarily masked. It may then become audible in these regions, essentially in the zone of frequencies [2000-2500 Hz] in FIG. 4.

A shaping of the coding noise is therefore necessary. A coding noise shaping adapted to an embedded-codes coding would be moreover desirable.

A noise shaping technique for a coding of PCM (for "Pulse Code Modulation") type with embedded codes is described in the recommendation ITU-T G.711.1 "Wideband embedded extension for G.711 pulse code modulation" or "G.711.1: A wideband extension to ITU-T G.711". Y. Hiwasaki, S. Sasaki, H. Ohmuro, T. Mori, J. Seong, M. S. Lee, B. Kövesi, S. Ragot, J.-L. Garcia, C. Marro, L. M., J. Xu, V. Malenovsky, J. Lapierre, R. Lefebvre, EUSIPCO, Lausanne, 2008.

This recommendation thus describes a coding with shaping of the coding noise for a core bitrate coding. A perceptual filter for shaping the coding noise is calculated on the basis of the past decoded signals, arising from an inverse core quantizer. A core bitrate local decoder therefore makes it possible to calculate the noise shaping filter. Thus, at the decoder, it is possible to calculate this noise shaping filter on the basis of the core bitrate decoded signals.

A quantizer delivering enhancement bits is used at the coder.

The decoder receiving the core binary stream and the enhancement bits, calculates the filter for shaping the coding noise in the same manner as at the coder on the basis of the core bitrate decoded signal and applies this filter to the output signal from the inverse quantizer of the enhancement bits, the shaped high-bitrate signal being obtained by adding the filtered signal to the decoded core signal.

The shaping of the noise thus enhances the perceptual quality of the core bitrate signal. It offers a limited enhancement in quality in respect of the enhancement bits. Indeed, the shaping of the coding noise is not performed in respect of the coding of the enhancement bits, the input of the quantizer being the same for the core quantization as for the enhanced quantization.

The decoder must then delete a resulting spurious component through suitably adapted filtering, when the enhancement bits are decoded in addition to the core bits.

The additional calculation of a filter at the decoder increases the complexity of the decoder.

This technique is not used in the already existing standard scalable decoders of G.722 or G.727 decoder type. There therefore exists a requirement to enhance the quality of the signals whatever the bitrate while remaining compatible with existing standard scalable decoders.

SUMMARY

The present invention is aimed at enhancing the situation.

For this purpose, it proposes a method of hierarchical coding of a digital audio signal comprising for a current frame of the input signal:

- a core coding, delivering a scalar quantization index for each sample of the current frame and
- at least one enhancement coding delivering indices of scalar quantization for each coded sample of an enhancement signal. The method is such that the enhancement coding comprises a step of obtaining a filter for shaping the coding noise used to determine a target signal and in that the indices of scalar quantization of the said enhancement signal are determined by minimizing the error between a set of possible values of scalar quantization and the said target signal.

Thus, a shaping of the coding noise of the enhancement signal of higher bitrate is performed. The synthesis-based analysis scheme forming the subject of the invention does not make it necessary to perform any complementary signal processing at the decoder, as may be the case in the coding noise shaping solutions of the prior art.

The signal received at the decoder will therefore be able to be decoded by a standard decoder able to decode the signal of core bitrate and of embedded bitrates which does not require any noise shaping calculation nor any corrective term.

The quality of the decoded signal is therefore enhanced whatever the bitrate available at the decoder.

The various particular embodiments mentioned hereinafter may be added independently or in combination with one another, to the steps of the method defined hereinabove.

Thus, a mode of implementation of the determination of the target signal is such that for a current enhancement coding stage, the method comprises the following steps for a current sample:

- obtaining an enhancement coding error signal by combining the input signal of the hierarchical coding with a signal reconstructed partially on the basis of a coding of a previous coding stage and of the past samples of the reconstructed signals of the current enhancement coding stage;
- filtering by the noise shaping filter obtained, of the enhancement coding error signal so as to obtain the target signal;
- calculation of the reconstructed signal for the current sample by addition of the reconstructed signal arising from the coding of the previous stage and of the signal arising from the quantization step;
- adaptation of memories of the noise shaping filter on the basis of the signal arising from the quantization step.

The arrangement of the operations which is described here leads to a shaping of the coding noise by operations of greatly reduced complexity.

In a particular embodiment, the set of possible scalar quantization values and the quantization value of the error signal for the current sample are values denoting quantization reconstruction levels, scaled by a level control parameter calculated with respect to the core bitrate quantization indices.

Thus, the values are adapted to the output level of the core coding.

In a particular embodiment, the values denoting quantization reconstruction levels for an enhancement stage k are defined by the difference between the values denoting the reconstruction levels of the quantization of an embedded quantizer with B+k bits, B denoting the number of bits of the core coding and the values denoting the quantization reconstruction levels of an embedded quantizer with B+k−1 bits, the reconstruction levels of the embedded quantizer with B+k bits being defined by splitting the reconstruction levels of the embedded quantizer with B+k−1 bits into two.

Moreover, the values denoting quantization reconstruction levels for the enhancement stage k are stored in a memory space and indexed as a function of the core bitrate quantization and enhancement indices.

The output values of the enhancement quantizer, which are stored directly in ROM, do not have to be recalculated for each sampling instant by subtracting the output values of the quantizer with B+k bit from those of the quantizer with B+k−1 bits. They are moreover for example arranged 2 by 2 in a table easily indexable by the index of the previous stage.

In a particular embodiment, the number of possible values of scalar quantization varies for each sample.

Thus, it is possible to adapt the number of enhancement bits as a function of the samples to be coded.

In another variant embodiment, the number of coded samples of said enhancement signal, giving the scalar quantization indices, is less than the number of samples of the input signal.

This may for example be the case when the allocated number of enhancement bits is set to zero for certain samples.

A possible mode of implementation of the core coding is for example an ADPCM coding using a scalar quantization and a prediction filter.

Another possible mode of implementation of the core coding is for example a PCM coding.

The core coding can also comprise a shaping of the coding noise for example with the following steps for a current sample:

- obtaining a prediction signal for the coding noise on the basis of past quantization noise samples and on the basis of past samples of quantization noise filtered by a predetermined noise shaping filter;
- combining the input signal of the core coding and the coding noise prediction signal so as to obtain a modified input signal to be quantized.

A shaping of the coding noise of lesser complexity is thus carried out for the core coding.

In a particular embodiment, the noise shaping filter is defined by an ARMA filter or a succession of ARMA filters.

Thus, this type of weighting function, comprising a value in the numerator and a value in the denominator, has the advantage through the value in the denominator of taking the signal spikes into account and through the value in the numerator of attenuating these spikes, thus affording optimal shaping of the quantization noise. The cascaded succession of ARMA filters allows better modeling of the masking filter by components for modeling the envelope of the spectrum of the signal and periodicity or quasi-periodicity components.

In a particular embodiment, the noise shaping filter is decomposed into two cascaded ARMA filtering cells of decoupled spectral slope and formantic shape.

Thus, each filter is adapted as a function of the spectral characteristics of the input signal and is therefore appropriate for the signals exhibiting various types of spectral slopes.

Advantageously, the noise shaping filter (W(z)) used by the enhancement coding is also used by the core coding, thus reducing the complexity of implementation.

In a particular embodiment, the noise shaping filter is calculated as a function of said input signal so as to best adapt to different input signals.

In a variant embodiment, the noise shaping filter is calculated on the basis of a signal locally decoded by the core coding.

The present invention also pertains to a hierarchical coder of a digital audio signal for a current frame of the input signal comprising:

- a core coding stage, delivering a scalar quantization index for each sample of the current frame; and
- at least one enhancement coding stage delivering indices of scalar quantization for each coded sample of an enhancement signal.

The coder is such that the enhancement coding stage comprises a module for obtaining a filter for shaping the coding noise used to determine a target signal and a quantization module delivering the indices of scalar quantization of said enhancement signal by minimizing the error between a set of possible values of scalar quantization and said target signal.

It also pertains to a computer program comprising code instructions for the implementation of the steps of the coding method according to the invention, when these instructions are executed by a processor.

The invention pertains finally to a storage means readable by a processor storing a computer program such as described.

BRIEF DESCRIPTION OF THE DRAWINGS

Other characteristics and advantages of the invention will be more clearly apparent on reading the following description, given solely by way of nonlimiting example and with reference to the appended drawings in which.

DETAILED DESCRIPTION

Hereinafter in the document, the term "prediction" is systematically employed to describe calculations using past samples only.

Figure 5:
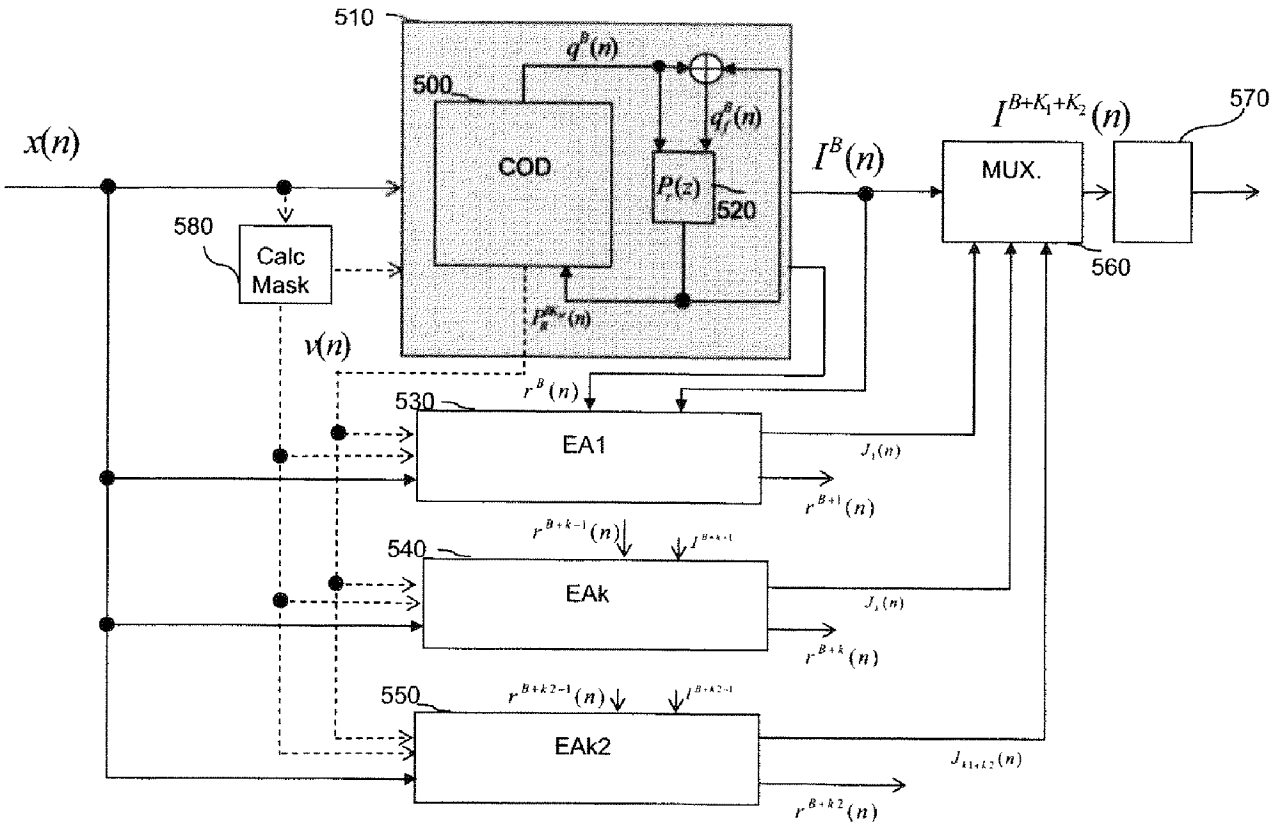
FIG. 5 represents a block diagram of an embedded-codes coder and of a coding method according to a general embodiment of the invention.

With reference to FIG. 5, an embedded-codes coder according to the invention is now described. It is important to note that the coding is performed with enhancement stages affording one bit per additional sample. This constraint is useful here only to simplify the presentation of the invention. It is however clear that the invention described hereinafter is easily generalized to the case where the enhancement stages afford more than one bit per sample.

This coder comprises a core bitrate coding stage 500 with quantization on B bits, of for example ADPCM coding type such as the standardized G.722 or G.727 coder or PCM ("Pulse Code Modulation") coder such as the G.711 standardized coder modified as a function of the outputs of the block 520.

The block referenced 510 represents this core coding stage with shaping of the coding noise, that is to say masking of the noise of the core coding, described in greater detail subsequently with reference to FIGS. 8, 15 or 16.

The invention such as presented, also pertains to the case where no masking of the coding noise in the core part is performed. Moreover, the term "core coder" is used in the broad sense in this document. Thus, an existing multi-bitrate coder such as for example ITU-T G.722 with 56 or 64 kbit/s may be considered to be a "core coder". In the extreme, it is also possible to consider a core coder with 0 kbit/s, that is to say to apply the enhancement coding technique which forms the subject of the present invention right from the first step of the coding. In the latter case the enhancement coding becomes core coding.

The core coding stage described here with reference to FIG. 5, with shaping of the noise, comprises a filtering module 520 performing the prediction $P_r(z)$ on the basis of the quantization noise $q^B(n)$ and of the filtered quantization noise $q_f^B(n)$ to provide a prediction signal $p_R^{BK_M}(n)$. The filtered quantization noise $q_f^B(n)$ is obtained for example by adding $K_M$ partial predictions of the filtered noise to the quantization noise such as described subsequently with reference to FIG. 9.

The core coding stage receives as input the signal x(n) and provides as output the quantization index $I^B(n)$, the signal $r^B(n)$ reconstructed on the basis of $I^B(n)$ and the scale factor of the quantizer v(n) in the case for example of an ADPCM coding as described with reference to FIG. 1.

The coder such as represented in FIG. 5 also comprises several enhancement coding stages. The stage EA1 (530), the stage EAk (540) and the stage EAk2 (550) are represented here.

An enhancement coding stage thus represented will subsequently be detailed with reference to FIGS. 6*a* and 6*b*.

Generally, each enhancement coding stage k has as input the signal x(n), the optimal index $I^{B+k-1}(n)$, the concatenation of the index $I^B(n)$ of the core coding and of the indices of the previous enhancement stages $J_1(n), \ldots, J_{k-1}(n)$ or equivalently the set of these indices, the signal reconstructed at the previous step $r^{B+k-1}(n)$, the parameters of the masking filter and if appropriate, the scale factor v(n) in the case of an adaptive coding.

This enhancement stage provides as output the quantization index $J_k(n)$ for the enhancement bits for this coding stage which will be concatenated with the index $I^{B+k-1}(n)$ in the concatenation module 560. The enhancement stage k also provides the reconstructed signal $r^{B+k}(n)$ as output. It should be noted that here the index $J_k(n)$ represents one bit for each sample of index n; however, in the general case $J_k(n)$ may represent several bits per sample if the number of possible quantization values is greater than 2.

Some of the stages correspond to bits to be transmitted $J_1(n), \ldots, J_{k1}(n)$ which will be concatenated with the index $I^B(n)$ so that the resulting index can be decoded by a standard decoder such as represented and described subsequently in FIG. 7. It is therefore not necessary to change the remote decoder; moreover, no additional information is required in order to "inform" the remote decoder of the processing performed at the coder.

Other bits $J_{k1+1}(n), \ldots, J_{k2}(n)$ correspond to enhancement bits by increasing the bitrate and masking and require an additional decoding module described with reference to FIG. 7.

The coder of FIG. 5 also comprises a module 580 for calculating the noise shaping filter or masking filter, on the basis of the input signal or of the coefficients of the synthesis filters of the coder as described subsequently with reference to FIGS. 13 and 14. Note that the module 580 could have the locally decoded signal as input, rather than the original signal.

The enhancement coding stages such as represented here make it possible to provide enhancement bits offering increased quality of the signal at the decoder, whatever the bitrate of the decoded signal and without modifying the decoder and therefore without any extra complexity at the decoder.

Thus, a module Eak of FIG. 5 representing an enhancement coding stage k according to one embodiment of the invention is now described with reference to FIG. 6*a*.

The enhancement coding performed by this coding stage comprises a quantization step $Q_{enh}^k$ which delivers as output an index and a quantization value minimizing the error between a set of possible quantization values and a target signal determined by use of the coding noise shaping filter.

Coders comprising embedded-codes quantizers are considered herein.

The stage k makes it possible to obtain the enhancement bit $J_k$ or a group of bits $J_k k=1, \ldots, G_K$.

It comprises a module EAk-1 for subtracting from the input signal x(n) the signal synthesized at stage k $r^{B+k}(n)$ for each previous sample $n'=n-1, \ldots, n-N_D$ of a current frame and of the signal $r^{B+k-1}(n)$ of the previous stage for the sample n, so as to give a coding error signal $e^{B+k}(n)$.

Figure 4:
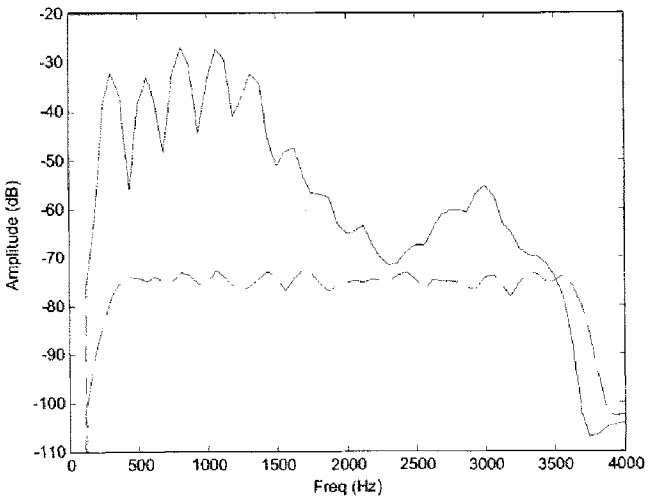
FIG. 4 represents a spectrum of a signal block with respect to the spectrum of a quantization noise present in a coder not implementing the present invention.

Rather than minimizing a quadratic error criterion which will give rise to quantization noise with a flat spectrum as represented with reference to FIG. 4, a weighted quadratic error criterion will be minimized in the quantization step, so that the spectrally shaped noise is less audible.

The stage k thus comprises a filtering module EAk-2 for filtering the error signal $e^{B+k}(n)$ by the weighting function W(z). This weighting function may also be used for the shaping of the noise in the core coding stage.

The noise shaping filter is here equal to the inverse of the spectral weighting, that is to say:

$$H^M(z) = \frac{1 - P_N^M(z)}{1 - P_D^M(z)} = \frac{1}{W(z)} \tag{1}$$

This shaping filter is of ARMA type ("AutoRegressive Moving Average"). Its transfer function comprises a numerator of order $N_N$ and a denominator of order $N_D$. Thus, the block EAk-1 serves essentially to define the memories of the non-recursive part of the filter W(z), which correspond to the denominator of $H^M(z)$. The definition of the memories of the recursive part of W(z) is not shown for the sake of conciseness, but it is deduced from $e_w^{B+k}(n)$ and from $enh_{2I^{B+k-1}+J}^{k_{B+k}}(n)v(n)$.

This filtering module gives, as output, a filtered signal $e_w^{B+k}(n)$ corresponding to the target signal.

The role of the spectral weighting is to shape the spectrum of the coding error, this being carried out by minimizing the energy of the weighted error.

A quantization module EAk-3 performs the quantization step which, on the basis of possible values of quantization output, seeks to minimize the weighted error criterion according to the following equation:

$$E_j^{B+k}=[e_w^{B+k}(n)-enh_{VCj}^{B+k}(n)]^2\ j=0,1 \quad (2)$$

This equation represents the case where an enhancement bit is calculated for each sample n. Two output values of the quantizer are then possible. We will see subsequently how the possible output values of the quantization step are defined.

This module EAk-3 thus carries out an enhancement quantization $Q_{enh}^k$ having as first output the value of the optimal bit $J_k$ to be concatenated with the index of the previous stage $I^{B+k-1}$ and as second output $enh_{VCJ}^{k_{B+k}}(n)=enh_{2I^{B+k-1}+J}^{k_{B+k}}(n)v(n)$, the output signal of the quantizer for the optimal index $J_k$ where v(n) represents a scale factor defined by the core coding so as to adapt the output level of the quantizers.

The enhancement coding stage finally comprises a module EAk-4 for adding the quantized error signal $enh_{2I^{B+k-1}+J}^{k_{B+k}}(n)v(n)$ to the signal synthesized at the previous stage $r^{B+k-1}(n)$ so as to give the synthesized signal at stage k $r^{B+k}(n)$.

In an equivalent manner, $r^{B+k}(n)$ may be obtained in replacement for EAk-4 by decoding the index $I^{B+k}(n)$, that is to say by calculating $[y_{2I^{B+k-1}+J}^{k_{B+k}}v(n)]_F$, optionally in finite precision, and by adding the prediction $x_P^B(n)$. In this case, it is appropriate to store in memory the quantization values $y_{2I^{B+k-1}+j}^{B+k}$ of the quantizers with B bits, B+1, . . . and to calculate the values of the enhancement quantizer by $[enh_{2I^{B+k-1}+j}^{B+k}v(n)]_F=[y_{2I^{B+k-1}+j}^{B+k}v(n)]_F-[y_{I^{B+k-1}}^{B+k-1}v(n)]_F$.

The signal $e^{B+k}(n)$ which had a value equal to $x(n')-r^{B+k-1}(n')$ for n'=n is supplemented according to the following relation for the following sampling instant:

$$e^{B+k}(n)\leftarrow e^{B+k}(n)-enh_{2I^{B+k-1}+J}^{k_{B+k}}(n)v(n) \quad (3)$$

where $e^{B+k}(n)$ is also the memory MA (for "Moving Average") of the filter. The number of samples to be kept in memory is therefore equal to the number of coefficients of the denominator of the noise shaping filter.

The memory of the AR (for "Auto Regressive") part of the filtering is then updated according to the following equation:

$$e_w^{B+k}(n)\leftarrow e_w^{B+k}(n)-enh_{2I^{B+k-1}+J}^{k_{B+k}}(n)v(n) \quad (5)$$

Figure 10:
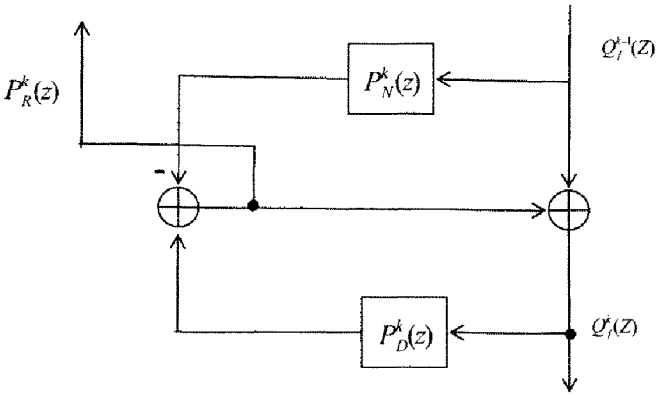
FIG. 10 illustrates a detailed function for calculating a coding noise of FIG. 9.

In the case of a filtering by arranging several ARMA cells in cascade, the internal variables of the filters with reference to FIG. 10 are adapted in the same way:

$$q_f^k(n)\leftarrow q_f^k(n)-enh_{2I^{B+k-1}+J}^{k_{B+k}}(n)v(n)$$

The index n is incremented by one unit. Once the initialization step has been performed for the first $N_D$ samples, the calculation of $e^{B+k}(n)$ will be done by shifting the storage memory for $e^{B+k}(n)$ (which involves overwriting the oldest sample) and by inserting the value $e^{B+k}(n)=x(n)-r^{B+k-1}(n)$ into the slot left free.

Figure 6A:
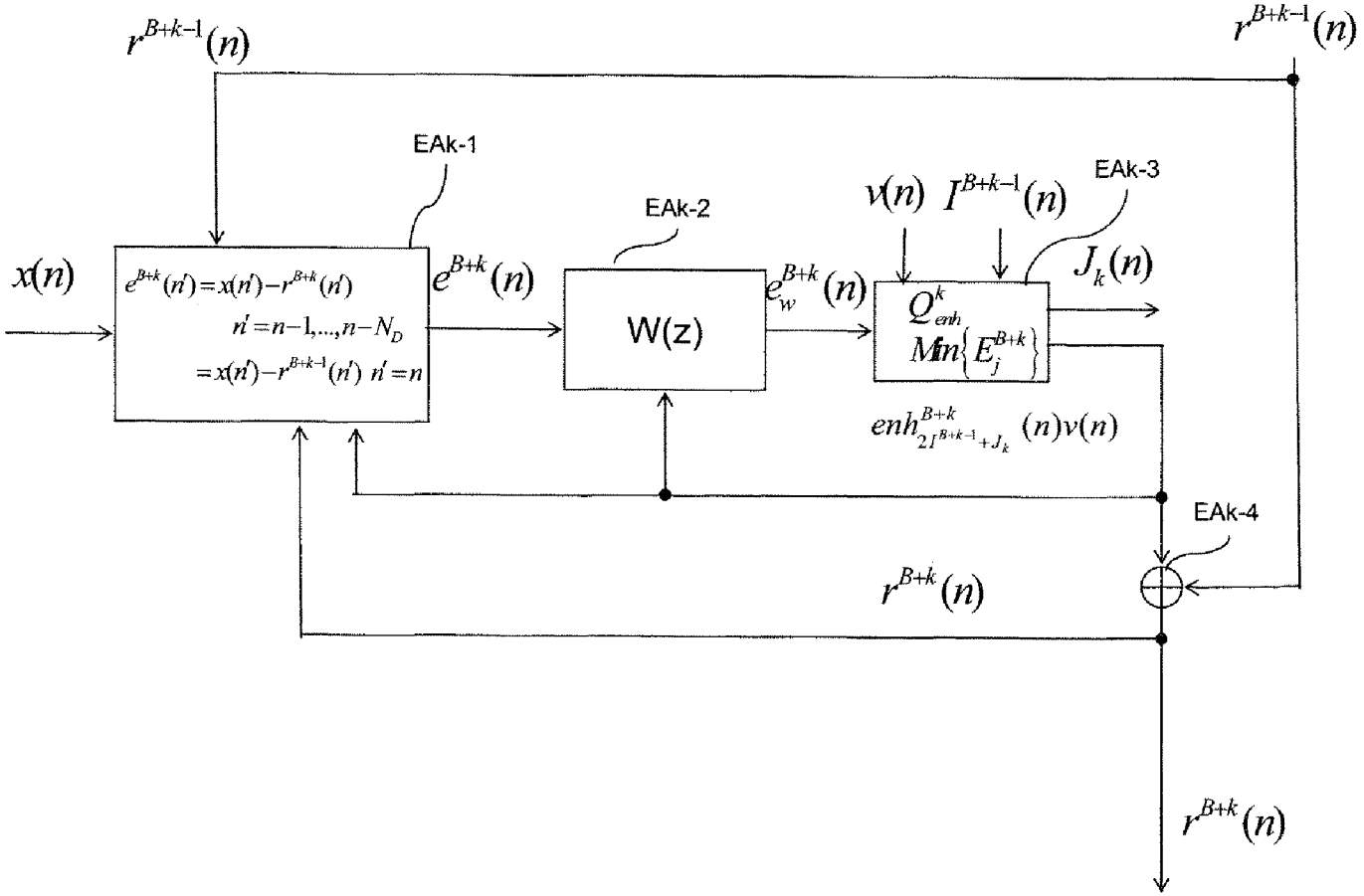
FIGS. 6*a* and 6*b* represent a block diagram of an enhancement coding stage and of an enhancement coding method according to the invention.

It may be noted that the invention shown in FIG. 6*a* may be carried out through equivalent variants. Indeed, the reconstructed signal may be decomposed into a part $s_{det}(n)$ determined solely by the samples already available (past samples n'=n−1, . . . , n−$N_D$, present samples of the previous stages, memories of the filters) and another part to be determined $s_{opt}(n)$ dependent solely on the present sample to be optimized. Thus, to optimize the calculational load, the calculation of the error to be minimized $E_j^{B+k}=[e_w^{B+k}(n)-enh_{VCj}^{B+k}(n)]^2$ j=0, 1, which is the weighted error between the input signal x(n) and the reconstructed signal $r^{B+k}(n)$ may also be decomposed into two parts. In a first step, the weighted difference by W(z) between the input sample x(n) and $s_{det}(n)$ is calculated (modules EAK-1 and EAK-2 of FIG. 6*a*). The value thus obtained $e_w^{B+k}(n)$ is the target signal at the instant n which reduces to a single target value, it need be calculated just once for each possible quantization value $enh_{VCj}^{B+k}(n)$. Next, in the optimization loop, it is necessary to simply find from among all the possible scalar quantization values that one which is the closest to this target value in the sense of the Euclidian distance.

Another variant for calculating the target value is to carry out two weighting filterings W(z). The first filtering weights the difference between the input signal and the reconstructed signal of the previous stage $r^{B-k-1}(n)$. The second filter has a zero input but these memories are updated with the aid of $enh_{2I^{B+k-1}+J}^{k_{B+k}}(n)v(n)$. The difference between the outputs of these two filterings gives the same target signal.

Figure 6B:
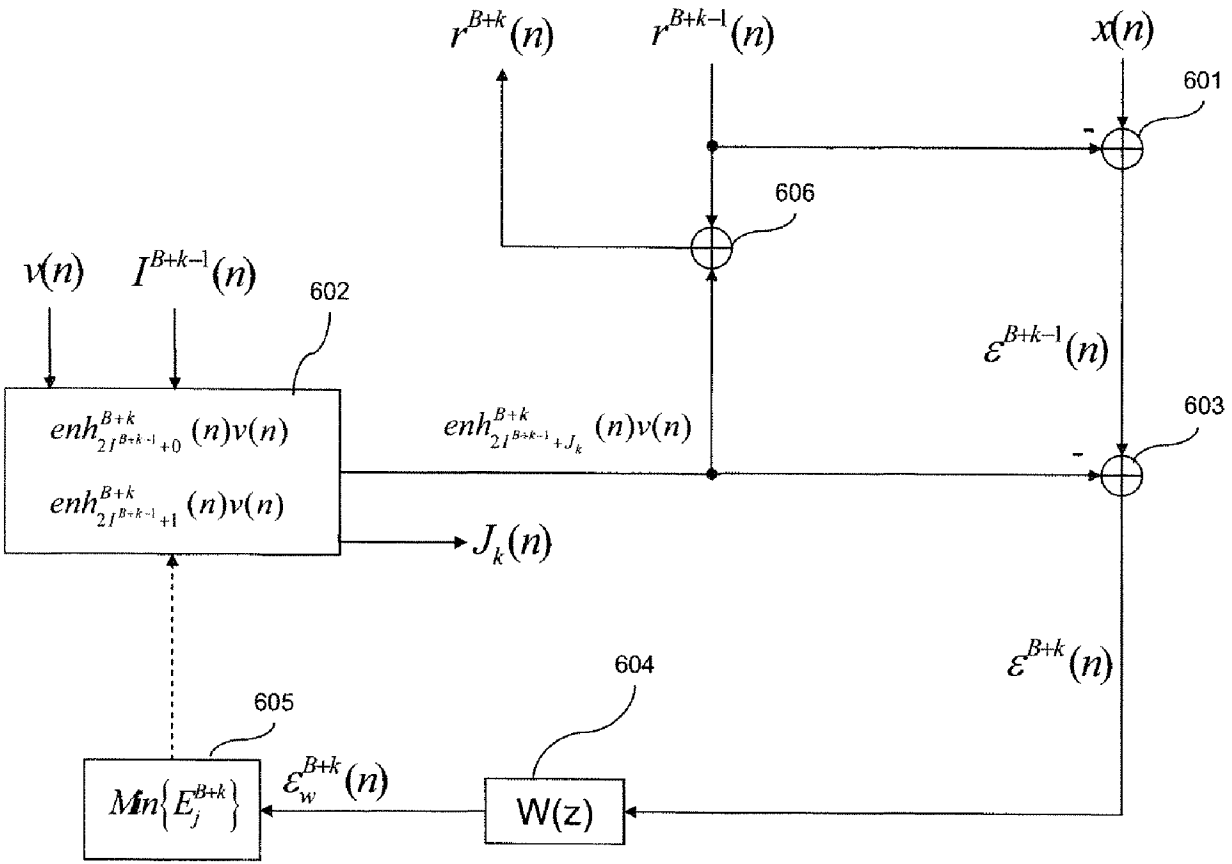

The principle of the invention described in FIG. 6*a* is generalized in FIG. 6*b*. The block 601 gives the coding error of the previous stage $\epsilon^{B+k-1}(n)$. The block 602 derives one by one all the possible scalar quantization values $enh_{2I^{B+k-1}+J}^{k_{B+k}}(n)v(n)$, which are subtracted from $\epsilon^{B+k-1}(n)$ by the block 603 to obtain the coding error $\epsilon^{B+k}(n)$ of the current stage. This error is weighted by the noise shaping filter W(z) (block 604) and minimized (block 605) so as to control the block 602. Ultimately, the value decoded locally by the enhancement coding stage is $r^{B+k}(n)=r^{B+k-1}(n)+enh_{2I^{B+k-1}+J}^{k_{B+k}}(n)v(n)$ (block 606).

It is important to note here that the notation $^{B+k}$ assumes that the bitrate per sample is B+k bits. FIG. 6 therefore treats the case where a single bit per sample is added by the enhancement coding stage, thus involving 2 possible quantization values in the block 602. It is obvious that the enhancement coding described in FIG. 6*b* can generate any number of bits k per sample; in this case, the number of possible scalar quantization values in the block 602 is $2^k$.

Figure 7:
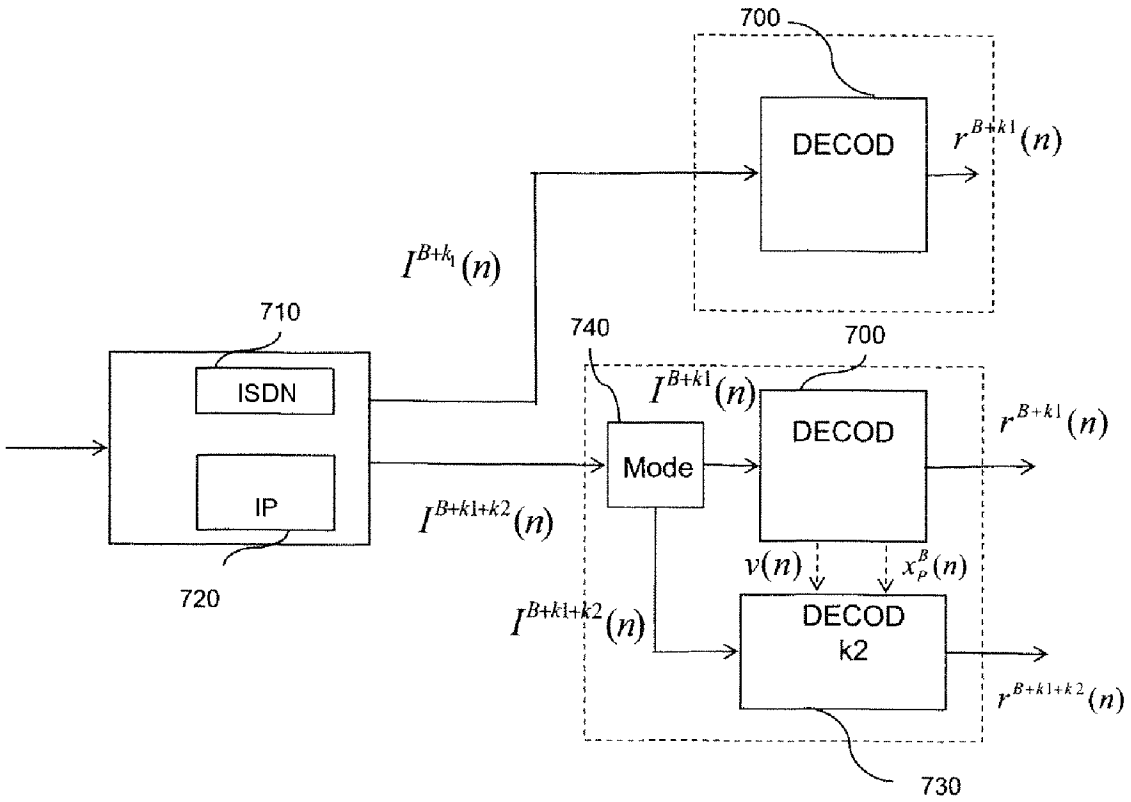
FIG. 7 illustrates various configurations of decoders adapted to the decoding of a signal arising from the coding according to the invention.

With reference to FIG. 7, we shall now describe various configurations of embedded-codes decoders able to decode the signal obtained as output from a coder according to the invention and such as described with reference to FIG. 5.

The decoding device implemented depends on the signal transmission bitrate and for example on the origin of the signal depending on whether it originates from an ISDN network 710 for example or from an IP network 720.

For a transmission channel with low bitrate (48, 56 or 64 kbit/s), it will be possible to use a standard decoder 700 for example of G.722 standardized ADPCM decoder type, to decode a binary train of B+k1 bits with k1=0, 1, 2 and B the number of bits of core bitrate. The restored signal $r^{B+k1}(n)$ arising from this decoding will benefit from enhanced quality by virtue of the enhancement coding stages implemented in the coder.

Figure 2:
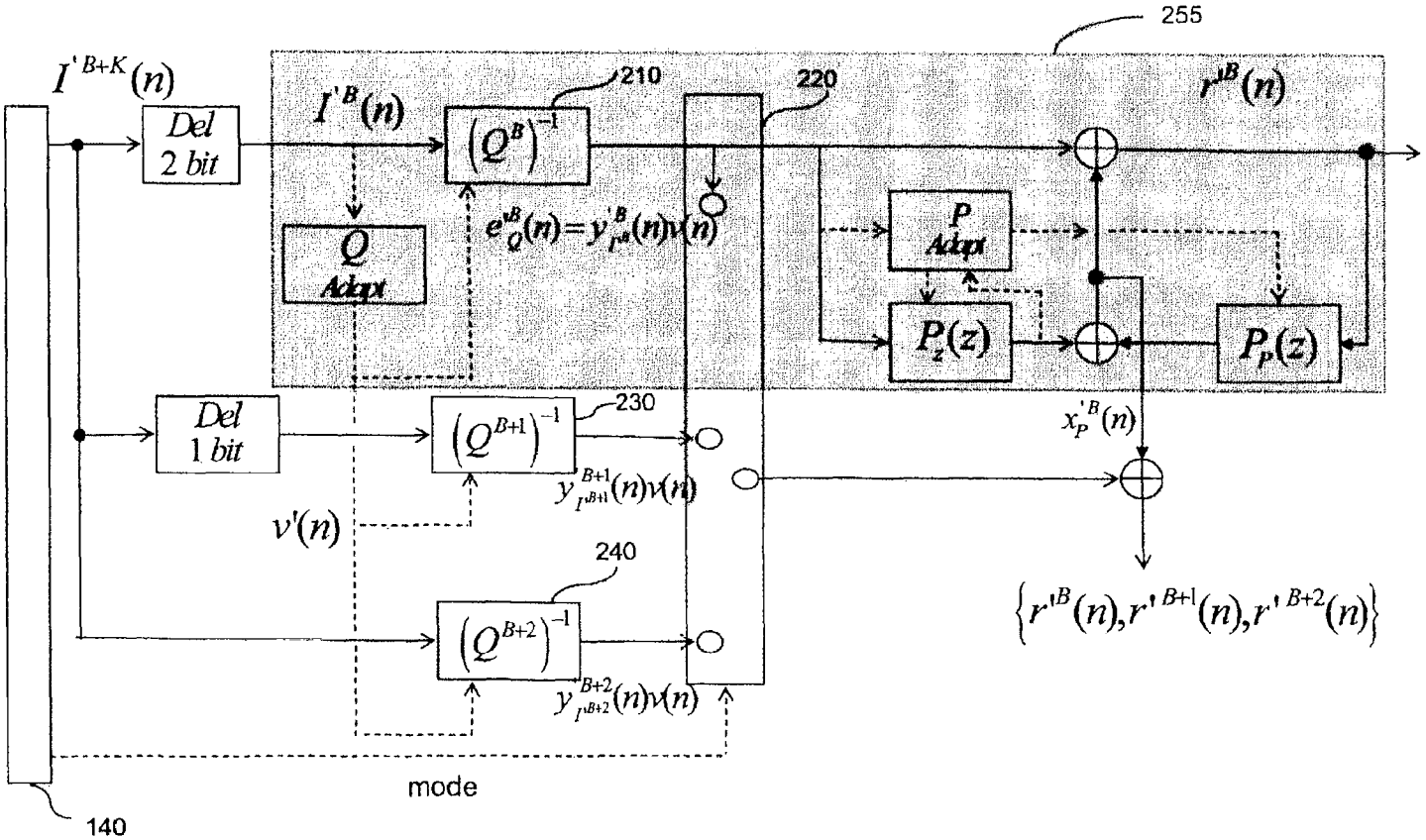
Fig.2 PRIOR ART
FIG. 2 illustrates a decoder of embedded-codes ADPCM type according to the prior art and such as previously described.
Figure 3:
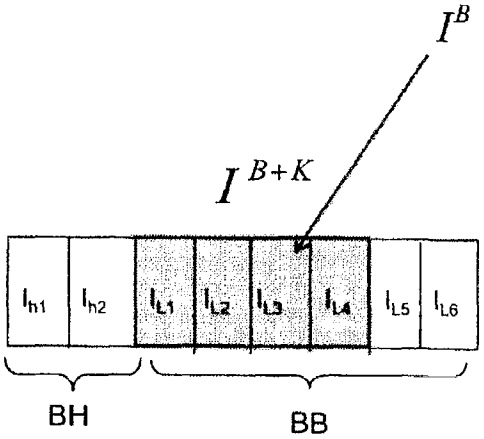
Fig.3 PRIOR ART
FIG. 3 illustrates an exemplary frame of quantization indices of a coder of embedded-codes ADPCM type according to the prior art and such as previously described.

For a transmission channel with higher bitrate, 80, 96 kbit/s, if the binary train $I^{B+k1+k2}(n)$ has a greater bitrate than the bitrate of the standard decoder 700 and indicated by the mode indicator 740, an extra decoder 730 then performs an inverse quantization of $I^{B+k1+k_2}(n)$, in addition to the inverse quantizations with B+1 and B+2 bits described with reference to FIG. 2 so as to provide the quantized error which when added to the prediction signal $x_P^B(n)$ will give the high-bitrate enhanced signal $r^{B+k1+k2}(n)$.

A first embodiment of a coder according to the invention is now described with reference to FIG. 8. In this embodiment, the core bitrate coding stage 800 performs a coding of ADPCM type with coding noise shaping.

The core coding stage comprises a module 810 for calculating the signal prediction $x_P^B(n)$ carried out on the basis of the previous samples of the quantized error signal $e_Q^B(n')=y_{I^B}^B(n')v(n')n'=n-1, \ldots, n-N_Z$ via the low bitrate index $I^B(n)$ of the core layer and of the reconstructed signal $r^B(n')n'=n-1, \ldots, n-N_P$ like that described with reference to FIG. 1.

A subtraction module 801 for subtracting the prediction $x_P^B(n)$ from the input signal x(n) is provided so as to obtain a prediction error signal $d_P^B(n)$.

The core coder also comprises a module 802 for predicting $P_r(z)$ noise $p_R^{BK_M}(n)$, carried out on the basis of the previous samples of the quantization noise $q^B(n')n'=n-1, \ldots, n-N_{NH}$ and of the filtering noise $q_f^{BK_M}(n')n'=n-1, \ldots, n-N_{DH}$.

An addition module 803 for adding the noise prediction $p_R^{BK_M}(n)$ to the prediction error signal $d_P^B(n)$ is also provided so as to obtain an error signal denoted $e^B(n)$.

A core quantization $Q^B$ module 820 receives as input the error signal $e^B(n)$ so as to give quantization indices $I^B(n)$. The optimal quantization index $I^B(n)$ and the quantized value $y_{I^B(n)}^B(n)v(n)$ minimize the error criterion $E_j^B=[e^B(n)-y_j^B(n)v(n)]^2$ $j=0, \ldots, N_Q-1$ where the values $y_j^B(n)$ are the reconstructed levels and v(n) the scale factor arising from the quantizer adaptation module 804.

By way of example for the G.722 coder, the reconstruction levels of the core quantizer $Q^B$ are defined by table VI of the article by X. Maitre. "7 kHz audio coding within 64 kbit/s", IEEE Journal on Selected Areas in Communication, Vol. 6-2, February 1988.

The quantization index $I^B(n)$ of B bits output by the quantization module $Q^B$ will be multiplexed in the multiplexing module 830 with the enhancement bits $J_1, \ldots, J_K$ before being transmitted via the transmission channel 840 to the decoder such as described with reference to FIG. 7.

The core coding stage also comprises a module 805 for calculating the quantization noise, this being the difference between the input of the quantizer and its output $q_Q^B(n)=e_Q^B(n)-e^B(n)$, a module 806 for calculating the quantization noise filtered by adding the quantization noise to the prediction of the quantization noise $q_f^{BK_M}(n)=q^B(n)+p_R^{BK_M}(n)$ and a module 807 for calculating the reconstructed signal by adding the prediction of the signal to the quantized error $r^B(n)=e_Q^B(n)+x_P^B(n)$ The quantizer $Q^B$ adaptation $Q_{Adapt}^B$ module 804 gives a level control parameter v(n) also called scale factor for the following instant n+1.

The prediction module 810 comprises an adaptation $P_{Adapt}$ module 811 for adaptation on the basis of the samples of the reconstructed quantized error signal $e_Q^B(n)$ and optionally of the reconstructed quantized error signal $e_Q^B(n)$ filtered by $1+P_z(z)$.

The module 850 Calc Mask detailed subsequently is designed to provide the filter for shaping the coding noise which may be used both by the core coding stage and the enhancement coding stages, either on the basis of the input signal, or on the basis of the signal decoded locally by the core coding (at the core bitrate), or on the basis of the prediction filter coefficients calculated in the ADPCM coding by a simplified gradient algorithm. In the latter case, the noise shaping filter may be obtained on the basis of coefficients of a prediction filter used for the core bitrate coding, by adding damping constants and adding a de-emphasis filter.

It is also possible to use the masking module in the enhancement stages alone; this alternative is advantageous in the case where the core coding uses few bits per sample, in which case the coding error is not white noise and the signal-to-noise ratio is very low—this situation is found in the ADPCM coding with 2 bits per sample of the high band (4000-8000 Hz) in the G.722 standard, in this case the noise shaping by feedback is not effective.

Figure 8:
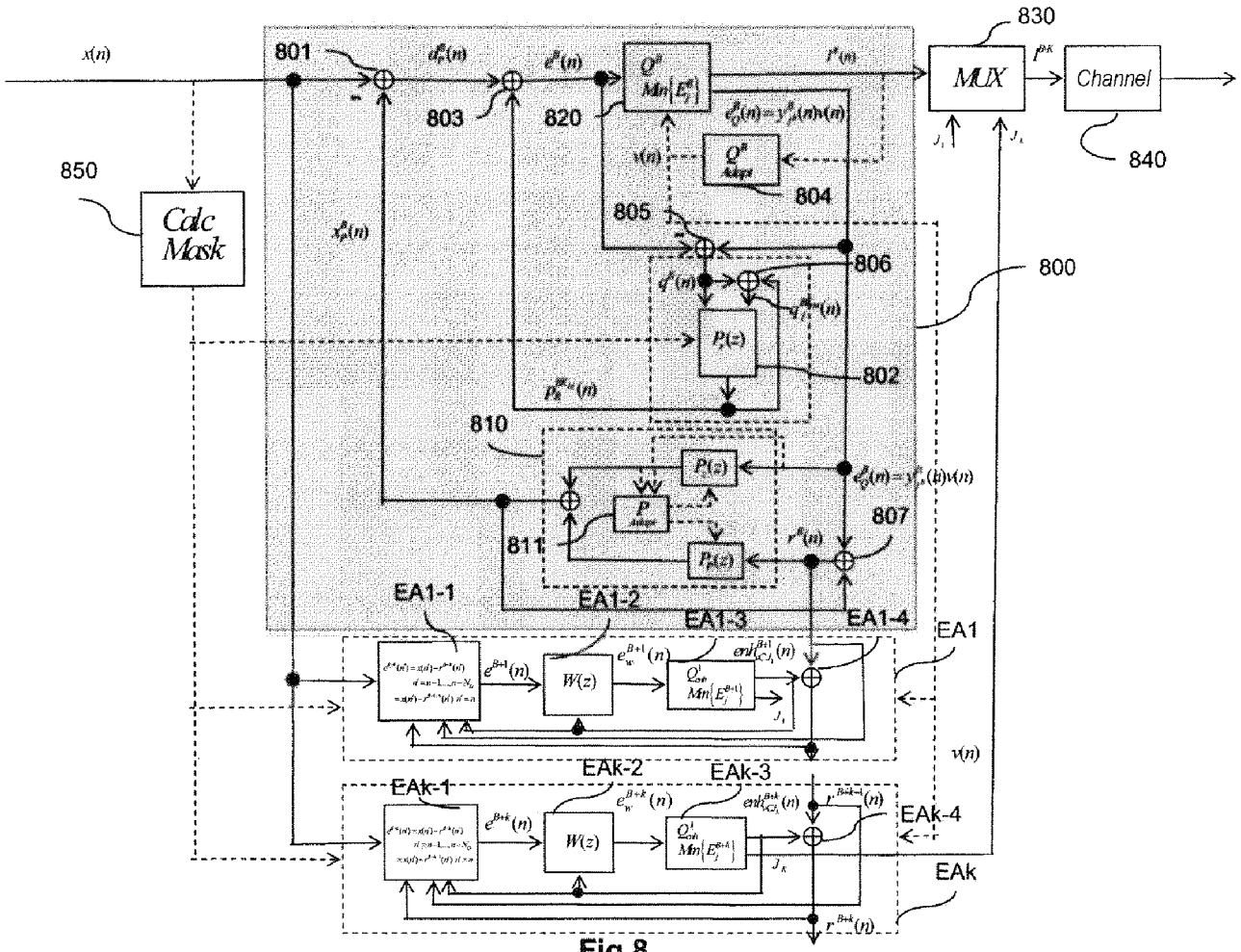
FIG. 8 represents a block diagram of a first detailed embodiment of a coder according to the invention and of a coding method according to the invention.

Note that the noise shaping of the core coding, corresponding to the blocks 802, 803, 805, 806 in FIG. 8, is optional. The invention such as represented in FIG. 16 applies even in respect of an ADPCM core coding reduced to the blocks 801, 804, 807, 810, 811, 820.

Figure 9:
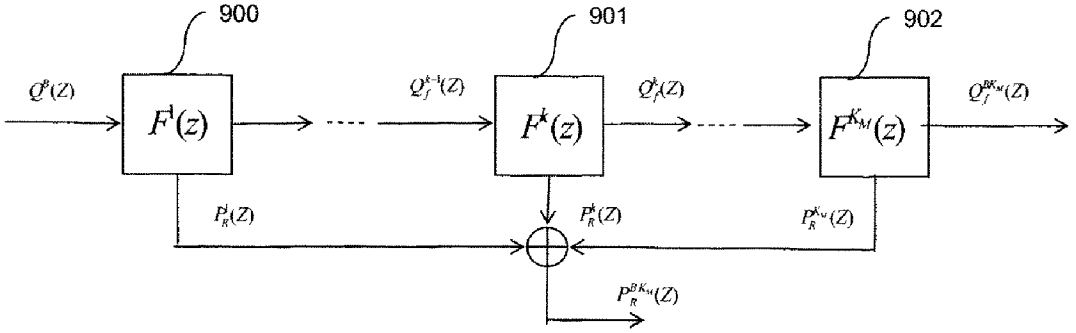
FIG. 9 illustrates an exemplary calculation of a coding noise for the core coding stage of a coder according to the invention.

FIG. 9 describes in greater detail the module 802 performing the calculation of the prediction of the quantization noise $P_R^{BK_M}(z)$ by an ARMA (for "AutoRegressive Moving Average") filter with general expression:

$$H^M(z)=\frac{1-P_N^M(z)}{1-P_D^M(z)} \tag{6}$$

For the sake of simplification, z-transform notation is used here.

In order to obtain a shaping of the noise which can take account, at one and the same time, of the short-term and long-term characteristics of the audiofrequency signals, the filter $H^M(z)$ is represented by cascaded ARMA filtering cells 900, 901, 902:

$$H^M(z)=\prod_{j=1}^{K_M} F^j(z)=\prod_{j=1}^{K_M}\frac{1-P_N^j(z)}{1-P_D^j(z)} \tag{7}$$

The filtered quantization noise of FIG. 9, arising from this filter cascade, will be given as a function of the quantization noise $Q^B(z)$ by:

$$Q_f^{BK_M}(z)=\prod_{j=1}^{K_M}\frac{1-P_N^j(z)}{1-P_D^j(z)}Q^B(z) \tag{8}$$

FIG. 10 shows in greater detail a module $F^k(z)$ 901. The quantization noise at the output of this cell k is given by:

$$Q_f^k(z)=Q_f^{k-1}(z)-P_N^k(z)Q_f^{k-1}(z)+P_D^k(z)Q_f^k(z) \tag{9}$$

Iterating with $k=1, \ldots, K_M$ yields:

$$Q_f^{BK_M}(z)=Q^B(z)+\sum_{k=1}^{K_M}P_D^k(z)Q_f^k(z)-P_N^k(z)Q_f^{k-1}(z) \tag{10}$$

i.e.:

$$Q_f^{BK_M}(z)=Q^B(z)+P_R^{BK_M}(z) \tag{11}$$

With the noise prediction $P_R^{BK_M}(z)$ given by:

$$P_R^{BK_M}(z) = \sum_{k=1}^{K_M} P_D^k(z)Q_f^k(z) - P_N^k(z)Q_f^{k-1}(z) \tag{12}$$

It is thus readily verified that the shaping of the core coding noise by FIG. 8 is effective through the following equations:

$$E^B(z)=X(z)-X_P^B(z)+P_R^{BK_M}(z) \tag{13}$$

$$Q^B(z)=E_Q(z)-E^B(z) \tag{14}$$

$$R^B(z)=E_Q(z)+X_P^B(z) \tag{15}$$

Whence:

$$R^B(z)=X(z)+Q_f^{BK_M}(z) \tag{16}$$

$$R^B(z) = X(z) + \prod_{j=1}^{K_M} \frac{1-P_N^j(z)}{1-P_D^j(z)} Q^B(z) \tag{17}$$

As the quantization noise is nearly white, the spectrum of the perceived coding noise is shaped by the filter $$H^M(z) = \prod_{j=1}^{K_M} \frac{1-P_N^j(z)}{1-P_D^j(z)}$$

and is therefore less audible.

As described subsequently all ARMA filtering cell may be deduced from an inverse filter for linear prediction of the input signal $$A_g(z) = 1 - \sum_{k=1}^{K} a_g(k)z^{-k}$$

by assigning coefficients $g_1$ and $g_2$ in the following manner:

$$\frac{1-P_N^j(z)}{1-P_D^j(z)} = \frac{A_{g1}(z)}{A_{g2}(z)} = \frac{1-\sum_{k=1}^{N_j} a_g(k)g_1^k z^{-k}}{1-\sum_{k=1}^{D_j} a_g(k)g_2^k z^{-k}} \tag{18}$$

This type of weighting function, comprising a value in the numerator and a value in the denominator, has the advantage through the value in the denominator of taking the signal spikes into account and through the value in the numerator of attenuating these spikes thus affording optimal shaping of the quantization noise. The values of $g_1$ and $g_2$ are such that:

$$1>g_2>g_1>0$$

The particular value $g_1=0$ gives a purely autoregressive masking filter and that of $g_2=0$ gives an MA moving average filter.

Moreover, in the case of voiced signals and that of digital audio signals of high fidelity, a slight shaping on the basis of the fine structure of the signal revealing the periodicities of the signal reduces the quantization noise perceived between the harmonics of the signal. The enhancement is particularly significant in the case of signals with relatively high fundamental frequency or pitch, for example greater than 200 Hz.

A long-term noise shaping ARMA cell is given by:

$$\frac{1-P_N^j(z)}{1-P_D^j(z)} = \frac{1-\sum_{k=-M_P}^{M_P} p_{2M_P}(k)z^{-(Pitch+k)}}{1-\sum_{k=-M_P}^{M_P} p_{1M_P}(k)z^{-(Pitch+k)}} \tag{19}$$

Returning to the description of FIG. 8, the coder also comprises several enhancement coding stages. Two stages EA1 and EAk are represented here.

The enhancement coding stage EAk makes it possible to obtain the enhancement bit $J_k$ or a group of bits $J_k k=1, G_K$ and is such as described with reference to FIGS. 6*a* and 6*b*.

This coding stage comprises a module EAk-1 for subtracting from the input signal x(n) the signal $r^{B+k}(n)$ formed of the synthesized signal at stage k $r^{B+k}(n)$ for the sampling instants $n-1, \ldots, n-N_D$ and of the signal $r^{B+k-1}(n)$ synthesized at stage k−1 for the instant n, so as to give a coding error signal $e^{B+k}(n)$.

A module EAk-2 for filtering $e^{B+k}(n)$ by the weighting function W(z) is also included in the coding stage k. This weighting function is equal to the inverse of the masking filter $H^M(z)$ given by the core coding such as previously described. At the output of the module EAk-2, a filtered signal $e_w^{B+k}(n)$ is obtained.

The enhancement coding stage k comprises a module EAk-3 for minimizing the error criterion $E_j^{B+k}$ for j=0, 1 carrying out an enhancement quantization $Q_{enh}^k$ having as first output the value of the optimal bit $J_k$ to be concatenated with the index of the previous stage $I^{B+k-1}$ and as second output $enh_{VCJ}^{kB+k}(n)=enh_{2I^{B+k-1}+J}^{kB+k}(n)v(n)$, the output signal from the quantizer for the optimal index $J_k$.

Stage k also comprises an addition module EAk-4 for adding the quantized error signal $enh_{2I^{B+k-1}+J}^{kB+k}(n)v(n)$ to the synthesized signal at the previous stage $r^{B+k-1}(n)$ so as to give the synthesized signal at stage k $r^{B+k}(n)$.

In the case of a single shaping ARMA filter, the filtered error signal is then given in z-transform notation, by:

$$E_W(z) = W^1(z)E(z) = \frac{1-P_D(z)}{1-P_N(z)}E(z) \tag{20}$$

Thus, for each sampling instant n, a partial reconstructed signal $r^{B+k}(n)$ is calculated on the basis of the signal reconstructed at the previous stage $r^{B+k-1}(n)$ and of the past samples of the signal $r^{B+k}(n)$.

This signal is subtracted from the signal x(n) to give the error signal $e^{B+k}(n)$.

The error signal is filtered by the filter having a filtering ARMA cell $W^1$ to give:

$$e_w^{B+k}(n) = e^{B+k}(n) - \sum_{k=1}^{N_D} p_D(k)e^{B+k}(n-k) + \sum_{k=1}^{N_N} p_N(k)e_w^{B+k}(n-k) \tag{21}$$

The weighted error criterion amounts to minimizing the quadratic error for the two values (or $N_G$ values if several bits) of possible outputs of the quantizer:

$$E_j^{B+k}=[e_w^{B+k}(n)-enh_{VCj}^{B+k}(n)]^2 \; j=0, 1 \tag{22}$$

This minimization step gives the optimal index $J_{k_k}$ and the quantized value for the optimal index $enh_{VCJ}^{k_{B+k}}(n)=enh_{2I^{B+k-1}+J}^{k_{B+k}}(n)v(n)$, also denoted $enh_{vJ}^{k_{B+k}}(n)v(n)$.

In the case where the masking filter consists of several cascaded ARMA cells, cascaded filterings are performed.

For example, for a cascaded short-term filtering and pitch cell we will have:

$$E_w^{B+k}(z)=\frac{1-\sum_{k=1}^{N_D}p_D(k)z^{-k}}{1-\sum_{k=1}^{N_N}p_N(k)z^{-k}}\frac{1-\sum_{k=-M_P}^{M_P}p_{2M_P}(k)z^{-(Pitch+k)}}{1-\sum_{k=-M_P}^{M_P}p_{1M_P}(k)z^{-(Pitch+k)}}E^{B+k}(z) \tag{23}$$

The output of the first filtering cell will be equal to:

$$e_{1w}^{B+k}(n)=e^{B+k}(n)-\sum_{k=1}^{N_D}p_D(k)e^{B+k}(n-k)+\sum_{k=1}^{N_N}p_N(k)e_{1w}^{B+k}(n-k) \tag{24}$$

And that of the second cell:

$$e_{2w}^{B+k}(n)=e_{1w}^{B+k}(n)-\sum_{k=-M_P}^{k=M_P}p_{2M_P}(k)e_{1w}^{B+k}(n-\text{Pitch}+k)+\sum_{k=-M_P}^{k=M_P}p_{1M_P}(k)e_{2w}^{B+k}(n-\text{Pitch}+k) \tag{25}$$

Once $enh_{vJ}^{k_{B+k}}(n)v(n)$ is obtained by minimizing the criterion, $e^{B+k}(n)$ is adapted by deducting $enh_{vJ}^{k_{B+k}}(n)v(n)$ from $e^{B+k}(n)$ and then the storage memory is shifted to the left and the value $r^{B+k+1}(n+1)$ is entered into the most recent position for the following instant n+1.

The memories of the filter are thereafter adapted by:

$$e_{1w}^{B+k}(n)=e_{1w}^{B+k}(n)-enh_{vJ}^{k_{B+k}}(n)v(n) \tag{28}$$

$$e_{2w}^{B+k}(n)=e_{2w}^{B+k}(n)-enh_{vJ}^{k_{B+k}}(n)v(n) \tag{29}$$

The previous procedure is iterated in the general case where $$E_w^{B+k}(z)=\prod_{j=1}^{K_M}\frac{1-P_N^j(z)}{1-P_D^j(z)}E^{B+k}(z) \tag{30}$$

Thus, the enhancement bits are obtained bit by bit or group of bits by group of bits in cascaded enhancement stages.

Figure 1:
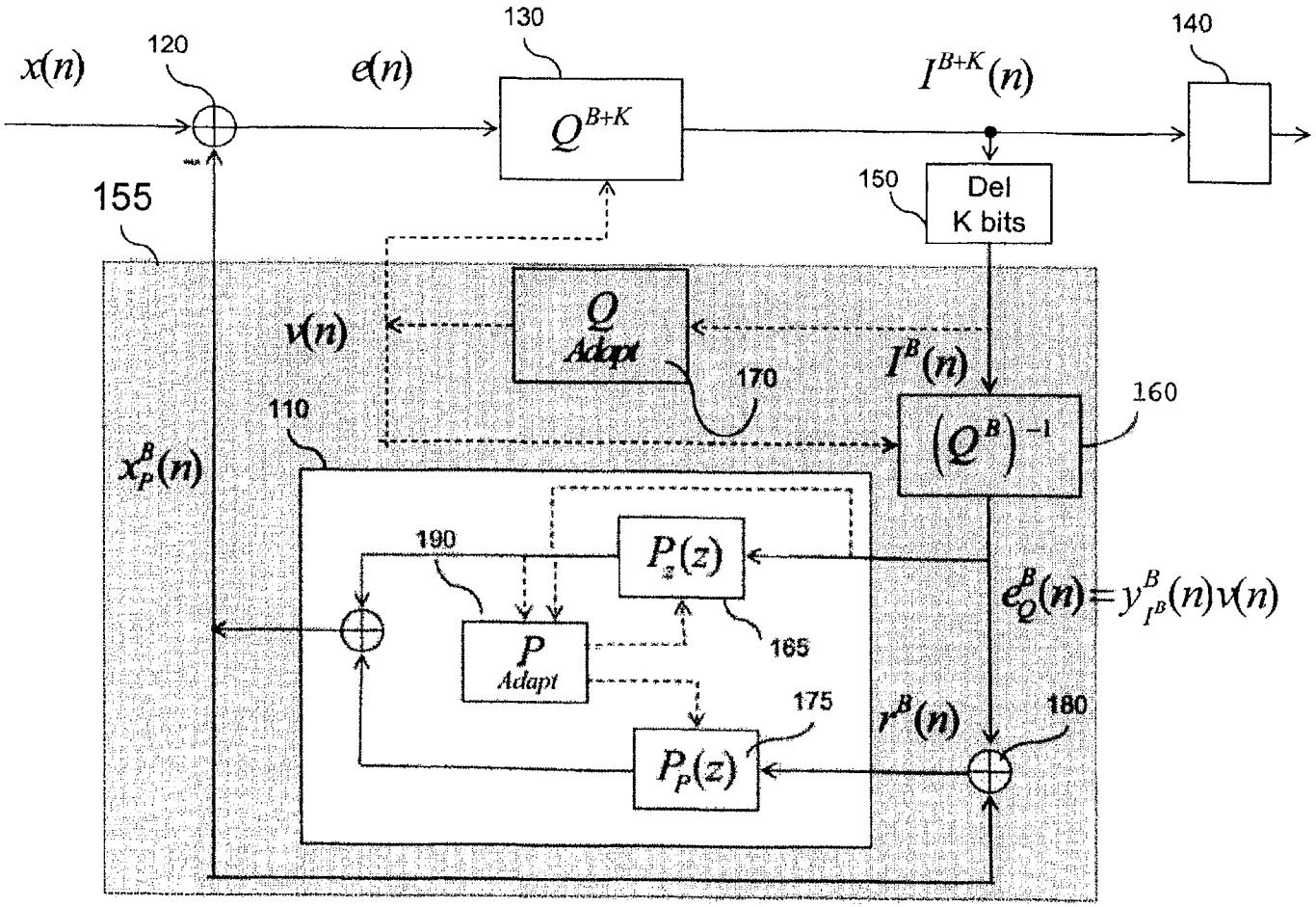
Fig.1 PRIOR ART
FIG. 1 illustrates a coder of embedded-codes ADPCM type according to the prior art and such as previously described.

In contradistinction to the prior art where the core bits of the coder and the enhancement bits are obtained directly by quantizing the error signal e(n) as represented in FIG. 1, the enhancement hits according to the invention are calculated in such a way that the enhancement signal at the output of the standard decoder is reconstructed with a shaping of the quantization noise.

Knowing the index $I^B(n)$ obtained at the output of the core quantizer and because the quantizer of ADPCM type with B+1 bits is an embedded-codes quantizer, only two output values are possible for the quantizer with B+1 bits.

The same reasoning applies in respect of the output of the enhancement stage with B+k bits as a function of the enhancement stage with B+k−1 bits.

Figure 11:
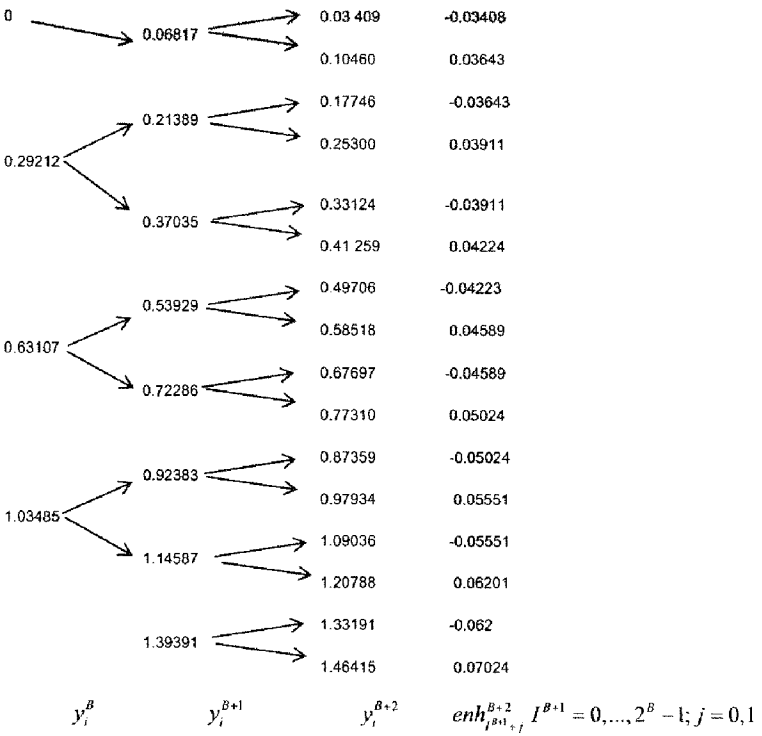
FIG. 11 illustrates an example of obtaining of a set of quantization reconstruction levels according to the coding method of the invention.

FIG. 11 represents the first 4 levels of the core quantizer with B bits for B=4 bits and the levels of the quantizers with B+1 and B+2 bits of the coding of the low band of a G.722 coder as well as the output values of the enhancement quantizer for B+2 bits.

As illustrated in this figure, the embedded quantizer with B+1=5 bits is obtained by splitting into two the levels of the quantizer with B=4 bits. The embedded quantizer with B+2=6 bits is obtained by splitting into two the levels of the quantizer with B+1=5 bits.

In an embodiment of the invention, the values denoting quantization reconstruction levels for an enhancement stage k are defined by the difference between the values denoting the reconstruction levels of the quantization of an embedded quantizer with B+k bits, B denoting the number of bits of the core coding and the values denoting the quantization reconstruction levels of an embedded quantizer with B+k−1 bits, the reconstruction levels of the embedded quantizer with B+k bits being defined by splitting the reconstruction levels of the embedded quantizer with B+k−1 bits into two.

We therefore have the following relation:

$$y_{2I^{B+k-1}+j}^{B+k}=y_{I^{B+k-1}}^{B+k-1}+enh_{2I^{B+k-1}+j}^{B+k}\ k=1,\ldots,K;\ j=0,1 \tag{31}$$

$y_{2I^{B+k-1}+j}^{B+k}$ representing the possible reconstruction levels of an embedded quantizer with B+k bits, $y_{I^{B+k-1}}^{B+k-1}$ representing the reconstruction levels of the embedded quantizer with B+k−1 bits and $enh_{2I^{B+k-1}+j}^{B+k}$ representing the enhancement term or reconstruction level for stage k. By way of example, the levels at the output of stage k=2, that is to say for B+k=6, are given in FIG. 11 as a function of the embedded quantizer for B+k=5 bits.

The possible outputs of the quantizer with B+k bits are given by:

$$e_{Q2I^{B+k-1}+j}^{B+k}=y_{I^{B+k-1}}^{B+k-1}v(n)+enh_{2I^{B+k-1}+j}^{B+k}v(n)k=1,\ldots,K;\ j=0,1 \tag{32}$$

v(n) representing the scale factor defined by the core coding so as to adapt the output level of the fixed quantizers.

With the prior art scheme, the quantization for the quantizers with B, B+1, . . . , B+K bits was performed just once by tagging the decision span of the quantizer with B+k bits in which the value e(n) to be quantized lies.

The present invention proposes a different scheme. Knowing the quantized value arising from the quantizer with B+k−1 bits, the quantization of the signal $e_w^{B+k}(n)$ at the input of the quantizer is done by minimizing the quantization error and without calling upon the decision thresholds, thereby advantageously making it possible to reduce the calculation noise for a fixed-point implementation of the product $enh_{2I^{B+k-1}+j}^{B+k}v(n)$ such that:

$$E_j^{B+k}=[(e_w^{B+k}(n)-y_{I^{B+k-1}}^{B+k-1}v(n)-enh_{2I^{B+k-1}+j}^{B+k}v(n)]^2\ j=0,1 \tag{33}$$

Rather than minimizing a quadratic error criterion which will give rise to quantization noise with a flat spectrum as represented with reference to FIG. 4, a weighted quadratic error criterion will be minimized, so that the spectrally shaped noise is less audible.

The spectral weighting function used is W(z), which may also be used for the noise shaping in the core coding stage.

Returning to the description of FIG. 8, it is seen that the core signal restored is equal to the sum of the prediction and of the output of the inverse quantizer, that is to say:

$$r^B(n)=x_p^B(n)+y_{I^B}^B v(n) \tag{34}$$

Because the signal prediction is performed on the basis of the core ADPCM coder, the two reconstructed signals possible at stage k are given as a function of the signal actually reconstructed at stage k−1 by the following equation:

$$r_j^{B+k}=x_P^B(n)+y_I^{B+k-1}v(n)+\mathrm{enh}_{2I^{B+k-1}+j}^{B+k}v(n) \quad (35)$$

From this is deduced the error criterion to be minimized at stage k:

$$E_j^{B+k}=\{x(n)-x_P^B(n)-y_I^{B+k-1}v(n)-\mathrm{enh}_{2I^{B+k-1}+j}^{B+k}v(n)]^2\ j=0,1 \quad (36)$$

i.e.:

$$E_j^{B+k}=[(x(n)-r^{B+k-1}(n))-\mathrm{enh}_{2I^{B+k-1}+j}^{B+k}v(n)]^2\ j=0,1 \quad (37)$$

Rather than minimizing a quadratic error criterion which will give rise to quantization noise with a flat spectrum as described previously, a weighted quadratic error criterion will be minimized, just as for the core coding, so that the spectrally shaped noise is less audible. The spectral weighting function used is W(z), that already used for the core coding in the example given—it is however possible to use this weighting function in the enhancement stages alone.

Figure 12:
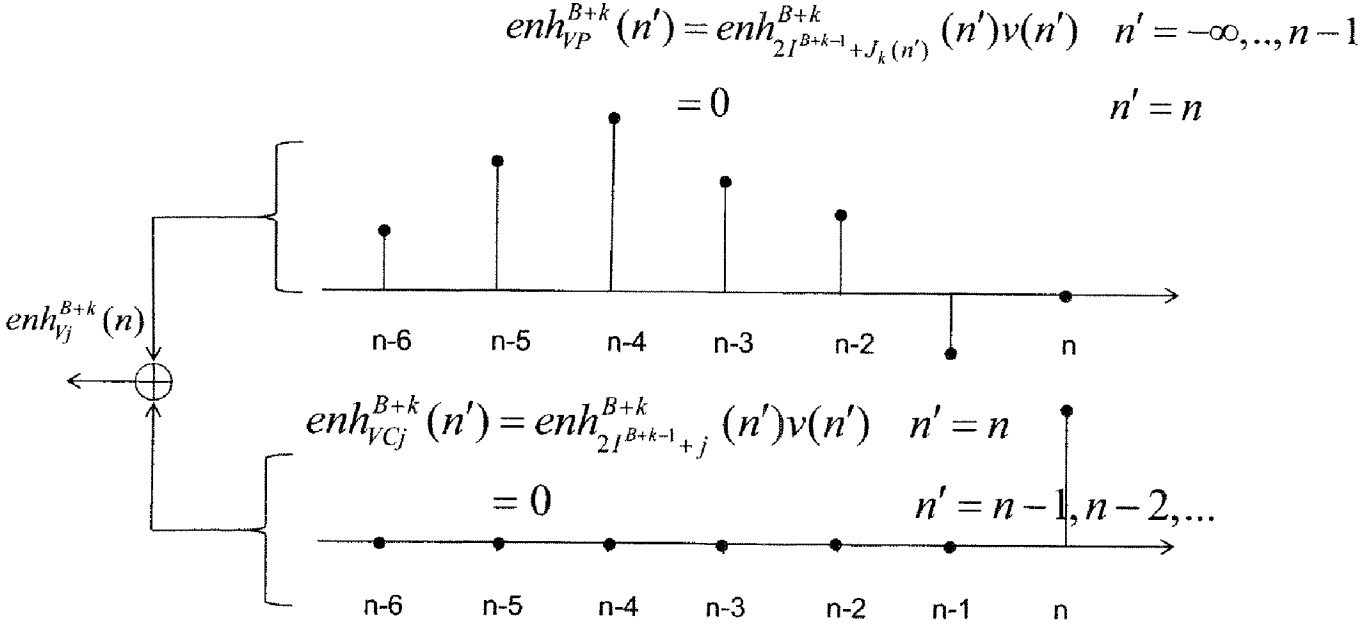
FIG. 12 illustrates a representation of the enhancement signal according to the coding method of the invention.

In accordance with FIG. 12, the signal $\mathrm{enh}_{Vj}^{B+k}(n')$ is defined as being equal to the sum of the two signals:

$\mathrm{enh}_{VP}^{B+k}(n')$ representing the concatenation of all the values $\mathrm{enh}_{2I^{B+k-1}+J_k(n')}^{B+k}(n')v(n')$ for n'<n and equal to 0 for n'=n and $\mathrm{enh}_{VCj}^{B+k}(n')$ equal to $\mathrm{enh}_{2I^{B+k-1}+j}^{B+k}(n')v(n')$ for n'=n and zero for n'<n.

The error criterion, which is easier to interpret in the domain of the z-transform, is then given by the following expression:

$$E_j^{B+k}=\frac{1}{2\pi j}\int_C|[(X(z)-R^{B+k-1}(z))-Enh_{Vj}^{B+k}(z)]W(z)|^2\ j=0,1 \quad (38)$$

Where $\mathrm{Enh}_{Vj}^{B+k}(z)$ is the z-transform of $\mathrm{enh}_{Vj}^{B+k}(n)$.

By decomposing $\mathrm{Enh}_{Vj}^{B+k}(z)$, we obtain:

$$E_j^{B+k}=\frac{1}{2\pi j}\int_C|\{X(z)-[R^{B+k-1}(z)+Enh_{VP}^{B+k}(z)]\}W(z)-Enh_{VCj}^{B+k}(z)|^2\ j=0,1 \quad (39)$$

For example, to minimize this criterion, we begin by calculating the signal:

$$R_P^{B+k}(z)=R^{B+k-1}(z)+\mathrm{Enh}_{VP}^{B+k}(z) \quad (40)$$

with $\mathrm{enh}_{VP}^{B+k}(n)=0$ since we do not yet know the quantized value. The sum of the signal of the previous stage and of $\mathrm{enh}_{VP}^{B+k}(n)$ is equal to the reconstructed signal of stage k.

$R_P^{B+k}(z)$, is therefore the z-transform of the signal equal to $r^{B+k}(n')$ for n'<n and equal to $r^{B+k-1}(n')$ for n'=n such that:

$$r_P^{B+k}(n')=r^{B+k}(n') \quad n'=n-1,\ldots,n-N_D$$
$$=r^{B+k-1}(n') \quad n'=n$$

For implementation on a processor, the signal $r^{B+k}(n)$ will not generally be calculated explicitly, but the error signal $e^{B+k}(n)$ will advantageously be calculated, this being the difference between x(n) and $r^{B+k}(n)$:

$$e^{B+k}(n')=x(n')-r^{B+k}(n') \quad n'=n-1,\ldots,n-N_D$$
$$=x(n')-r^{B+k-1}(n') \quad n'=n \quad (41)$$

$e^{B+k}(n)$ is formed on the basis of $r^{B+k-1}(n)$ and of $r^{B+k}(n)$ and the number of samples to be kept in memory for the filtering which will follow is $N_D$ samples, the number of coefficients of the denominator of the masking filter.

The filtered error signal $E_w^{B+k}(z)$ will be equal to:

$$E_w^{B+k}(z)=E^{B+k}(z)W(z) \quad (42)$$

The weighted quadratic error criterion is deduced from this:

$$E_j^{B+k}=\{e_w^{B+k}(n)-\mathrm{enh}_{VCj}^{B+k}(n)]^2 \quad (43)$$

The optimal index $J_k$ is that which minimizes the criterion $E_j^{B+k}$ for j=0, 1 thus carrying out the scalar quantization $Q_{enh}^k$ on the basis of the two enhancement levels $\mathrm{enh}_{VCj}^{B+k}(n)$ j=0, 1 calculated on the basis of the reconstruction levels of the scalar quantizer with B+k bits and knowing the optimal core index and the indices $J_i$ i=1, . . . , k−1 or equivalently $I^{B+k-1}$.

The output value of the quantizer for the optimal index is equal to:

$$\mathrm{enh}_{VCJ}^{kB+k}(n)=\mathrm{enh}_{2I^{B+k-1}+J}^{kB+k}(n)v(n) \quad (44)$$

and the value of the reconstructed signal at the instant n will be given by:

$$r^{B+k}(n)=r^{B+k-1}(n)+\mathrm{enh}_{2I^{B+k-1}+J}^{kB+k}(n)v(n) \quad (45)$$

Knowing the quantized output $\mathrm{enh}_{VCJ}^{kB+k}(n)=\mathrm{enh}_{2I^{B+k-1}+J}^{kB+k}(n)v(n)$, the difference signal $e^{B+k}(n)$ is updated for the sampling instant n:

$$e^{B+k}(n)\leftarrow e^{B+k}(n)-\mathrm{enh}_{2I^{B+k-1}+J}^{kB+k}(n)v(n)$$

And the memories of the filter are adapted.

The value of n is incremented by one unit. It is then realized that the calculation of $e^{B+k}(n)$ is extremely simple: it suffices to drop the oldest sample by shifting the storage memory for $e^{B+k}(n)$ by one slot to the left and to insert as most recent sample $r^{B+k-1}(n+1)$, the quantized value not yet being known. The shifting of the memory may be avoided by using the pointers judiciously.

Figure 14:
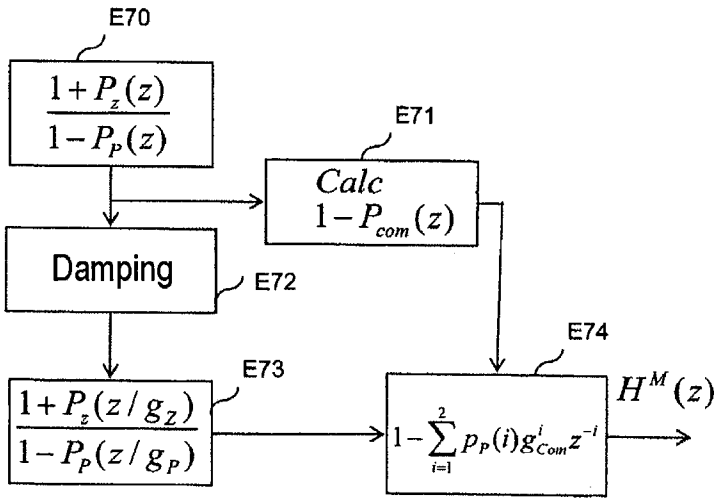
FIG. 14 illustrates a flowchart representing the steps of a second embodiment of the calculation of the masking filter for the coding according to the invention.
Figure 13:
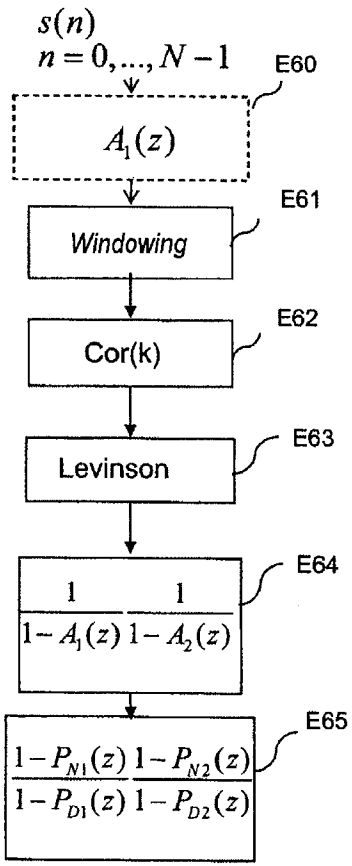
FIG. 13 illustrates a flowchart representing the steps of a first embodiment of the calculation of the masking filter for the coding according to the invention.

FIGS. 13 and 14 illustrate two modes of implementation of the masking filter calculation implemented by the masking filter calculation module 850.

In a first mode of implementation illustrated in FIG. 13, a signal current block which corresponds to the current-frame block supplemented with a sample segment of the previous frame S(n), n=$-N_s$, . . . , −1, 0, . . . , $N_T$ is taken into account.

To accentuate the spikes of the spectrum of the masking filter, the signal is pre-processed (pre-emphasis processing) before the calculation at E60 of the correlation coefficients by a filter $A_1(z)$ whose coefficient or coefficients are either fixed or adapted by linear prediction as described in patent FR2742568.

In the case where a pre-emphasis is used the signal to be analyzed $S_p(n)$ is calculated by inverse filtering:

$$S_P(z)=A_1(z)S(z).$$

The signal block is thereafter weighted at E 61 by a Hanning window or a window formed of the concatenation of sub-windows, as known from the prior art.

The $K_{c2}+1$ correlation coefficients are thereafter calculated at E62 by:

$$Cor(k) = \sum_{n=0}^{N-1} s_P(n)s_P(n-k) \quad (46)$$

$$k = 0, \ldots, K_{c2}$$

The coefficients of the AR filter (fir AutoRegressive) $A_2(Z)$ which models the envelope of the pre-emphasized signal are given at E63 by the Levinson-Durbin algorithm.

A filter A(z) is therefore obtained at E64, said filter having transfer function $$\frac{1}{A(z)} = \frac{1}{1-A_1(z)}\frac{1}{1-A_2(z)}$$

modeling the envelope of the input signal.

When this calculation is implemented for the two filters $1-A_1(z)$ and $1-A_2(z)$ of the coder according to the invention, a shaping filter is thus obtained at E65, given by:

$$H^M(z) = \frac{1-P_{N1}(z)}{1-P_{D1}(z)}\frac{1-P_{N2}(z)}{1-P_{D2}(z)} \quad (47)$$

$$= \frac{1-\sum_{k=1}^{K_{c1}} a_1(k)g_{N1}^k z^{-k}}{1-\sum_{k=1}^{K_{c1}} a_1(k)g_{D1}^k z^{-k}}\frac{1-\sum_{k=1}^{K_{c2}} a_2(k)g_{N2}^k z^{-k}}{1-\sum_{k=1}^{K_{c2}} a_2(k)g_{D2}^k z^{-k}}$$

The constants $g_{N1}$, $g_{D1}$, $g_{N2}$ and $g_{D2}$ make it possible to fit the spectrum of the masking filter, especially the first two which adjust the slope of the spectrum of the filter.

A masking filter is thus obtained, formed by cascading two filters where the slope filters and formant filters have been decoupled. This modeling where each filter is adapted as a function of the spectral characteristics of the input signal is particularly adapted to signals exhibiting any type of spectral slope. In the case where $g_{N1}$ and $g_{N2}$ are zero, a cascade masking filtering of two autoregressive filters, which suffice as a first approximation, is obtained.

A second exemplary implementation of the masking filter, of low complexity, is illustrated with reference to FIG. 14.

The principle here is to use directly the synthesis filter of the ARMA filter for reconstructing the decoded signal with a &accentuation applied by a compensation filter dependent on the slope of the input signal.

The expression for the masking filter is given by:

$$H^M(z) = \frac{1-P_z(z/g_{z1})}{1-P_P(z/g_{z2})}[1-P_{Com}(z)] \quad (48)$$

In the G.722, G.726 and G.727 standards the ADPCM ARMA predictor possesses 2 coefficients in the denominator. In this case the compensation filter calculated at E71 will be of the form:

$$1-P_{Com}(z) = 1-\sum_{i=1}^{2} p_P(i)g_{Com}^i z^{-i} \quad (49)$$

And the filters $P_z(z)$ and $P_P(z)$ given at E70 will be replaced with their version restrained by damping constants $g_{Z1}$ and $g_{P1}$ given at E72, to give a noise shaping filter of the form:

$$H^M(z) = \frac{1+\sum_{i=1}^{N_Z} p_Z(i)g_{Z1}^i z^{-i}}{1-\sum_{i=1}^{N_P} p_P(i)g_{P1}^i z^{-i}}\left[1-\sum_{i=1}^{2} p_{Com}(i)g_{Com}^i z^{-i}\right] \quad (50)$$

By taking:

$p_{Com}(i)=0$ $i=1, 2$ a simplified form of the masking filter consisting of an ARMA cell is obtained.

Another very simple form of masking filter is that obtained by taking only the denominator of the ARMA predictor with a slight damping:

$$H^M(z) = \frac{1}{1-P_P(z/g_P)} \quad (51)$$

with for example $g_P$=0.92.

This AR filter for partial reconstruction of the signal leads to reduced complexity.

In a particular embodiment and to avoid adapting the filters at each sampling instant, it will be possible to freeze the coefficients of the filter to be damped on a signal frame or several times per frame so as to preserve a smoothing effect.

One way of performing the smoothing is to detect abrupt variations in dynamic swing on the signal at the input of the quantizer or in a way which is equivalent but of minimum complexity directly on the indices at the output of the quantizer. Between two abrupt variations of indices is obtained a zone where the spectral characteristics fluctuate less, and therefore with ADPCM coefficients that are better adapted with a view to masking.

The calculation of the coefficients of the cells for long-term shaping of the quantization noise.

$$F^j(z) = \frac{1-\sum_{k=-M_P}^{M_P} p_{2M_P}(k)z^{-(Pitch+k)}}{1-\sum_{k=-M_P}^{M_P} p_{1M_P}(k)z^{-(Pitch+k)}} \quad (52)$$

is performed on the basis of the input signal of the quantizer which contains a periodic component for the voiced sounds. It may be noted that long-term noise shaping is important if one wishes to obtain a worthwhile enhancement in quality for periodic signals, in particular for voiced speech signals. This is in fact the only way of taking into account the periodicity of periodic signals for coders whose synthesis model does not comprise any long-term predictor.

The pitch period is calculated, for example, by minimizing the long-term quadratic prediction error at the input $e^B(n)$ of the quantizer $Q^B$ of FIG. 8, by maximizing the correlation coefficient:

$$Cor(i)^2 = \frac{\left(\sum_{n=-1}^{-N_P} e^B(n)e^B(n-i)\right)^2}{\sum_{n=-1}^{-N_P} e^B(n)^2 \sum_{n=-1}^{-N_P} e^B(n-i)^2} \quad (53)$$

$$i = P_{Min}, \ldots, P_{Max}$$

Pitch is such that:

$$\mathrm{Cor(Pitch)=Max}\{\mathrm{Cor}(i)\}i=P_{Min}, \ldots, P_{Max}$$

The pitch prediction gain $\mathrm{Cor}_f(i)$ used to generate the masking filters is given by:

$$Cor_f(\mathrm{Pitch}+i) = \frac{\sum_{n=-1}^{-N_P} e^B(n)e^B(n-\mathrm{Pitch}+i)}{\sqrt{\sum_{n=-1}^{-N_P} e^B(n)^2 \sum_{n=-1}^{-N_P} e^B(n-\mathrm{Pitch}+i)^2}}$$

The coefficients of the long-term masking filter will be given by:

$$p_{2M_p}(i)=g_{2pitch}\mathrm{Cor}_f(\mathrm{Pitch}+i)i=-M_P, \ldots, M_P$$

And $$p_{1M_P}(i)=g_{1Pitch}\mathrm{Cor}_f(\mathrm{Pitch}+i)\ i=-M_P, \ldots, M_P$$

A scheme for reducing the complexity of calculation of the value of the pitch is described by FIG. 8-4 of the ITU-T G.711.1 standard "Wideband embedded extension for G.711 pulse code modulation"

Figure 15:
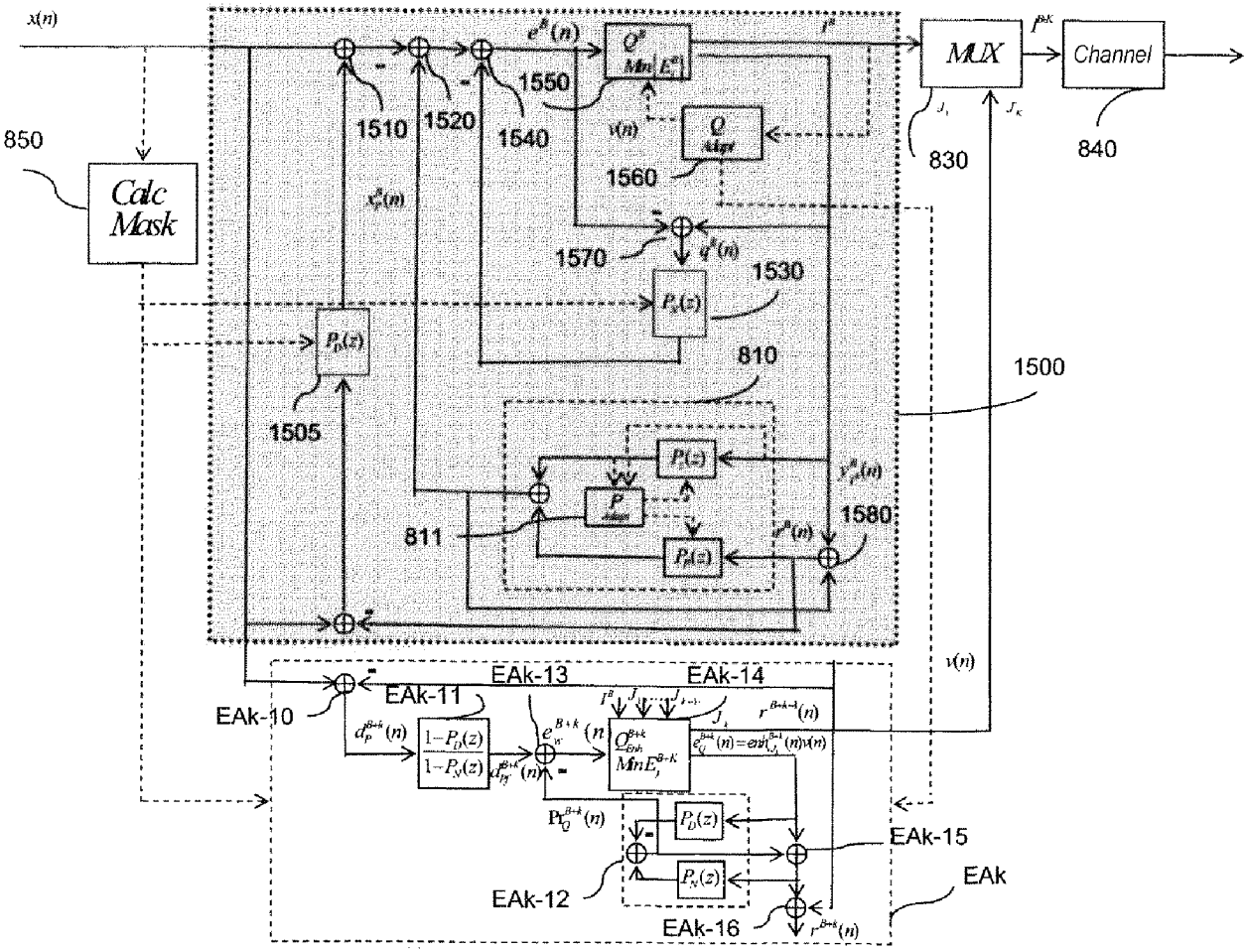
FIG. 15 represents a block diagram of a second detailed embodiment of a coder according to the invention and of a coding method according to the invention.

FIG. 15 proposes a second embodiment of a coder according to the invention.

This embodiment uses prediction modules in place of the filtering modules described with reference to FIG. 8, both for the core coding stage and for the enhancement coding stages.

In this embodiment, the coder of ADPCM type with core quantization noise shaping comprises a prediction module 1505 for predicting the reconstruction noise $P_D(z)[X(z)-R^B(z)]$, this being the difference between the input signal x(n) and the low bitrate synthesized signal $r^B(n)$ and an addition module 1510 for adding the prediction to the input signal x(n).

It also comprises a prediction module 810 for the signal $x_P^B(n)$ identical to that described with reference to FIG. 8, carrying out a prediction on the basis of the previous samples of the error signal $e_Q^B(n')=y_I^B(n')v(n')n'=n-1, \ldots, n-N_Z$ quantized via the low bitrate quantization index $I^B(n)$ and of the reconstructed signal $r^B(n')n'=n-1, \ldots, n-N_P$. A subtraction module 1520 for subtracting the prediction $x_P^B(n)$ from the modified input signal x(n) provides a prediction error signal.

The core coder also comprises a module $P_N(z)$ 1530 for calculating the noise prediction carried out on the basis of the previous samples of the quantization noise $q^B(n')n'=n-1, \ldots, n-N_{NH}$ and a subtraction module 1540 for subtracting the prediction thus obtained from the prediction error signal to obtain an error signal denoted $e^B(n)$.

A core quantization module $Q^B$ at 1550 performs a minimization of the quadratic error criterion $E_j^{B=[eB}(n)-y_j^B(n)v(n)]^2$ $j=0, \ldots, N_Q-1$ where the values $y_j^B(n)$ are the reconstructed levels and v(n) the scale factor arising from the quantizer adaptation module 1560. The quantization module receives as input the error signal $e^B(n)$ as to give as output quantization indices $I^B(n)$ and the quantized signal $e_Q^B(n)=y_I^B(n)v(n)$. By way of example for G.722, the reconstruction levels of the core quantizer $Q^B$ are defined by the table VI of the article by X. Maitre. "7 kHz audio coding within 64 kbit/s". IEEE Journal on Selected Areas in Communication, Vol. 6-2, February 1988.

The quantization index $I^B(n)$ of B bits at the output of the quantization module $Q^B$ will be multiplexed at 830 with the enhancement bits $J_1, \ldots, J_k$ before being transmitted via the transmission channel 840 to the decoder such as described with reference to FIG. 7.

A module for calculating, the quantization noise 1570 computes the difference between the input of the quantizer and the output of the quantizer $q_Q^B(n)=e_Q^B(n)-e^B(n)$.

A module 1580 calculates the reconstructed signal by adding the prediction of the signal to the quantized error $r^B(n)=e_Q^B(n)+x_P^B(n)$.

The adaptation module $Q_{Adapt}$ 1560 of the quantizer gives a level control parameter v(n) also called scale factor for the following instant.

An adaptation module $P_{Adapt}$ 811 of the prediction module performs an adaptation on the basis of the past samples of the reconstructed signal $r^B(n)$ and of the reconstructed quantized error signal $e_Q^B(n)$.

The enhancement stage EAk comprises a module EAk-10 for subtracting the signal reconstructed at the preceding stage $r^{B+k-1}(n)$ from the input signal x(n) to give the signal $d_P^{B+k}(n)$.

The filtering of the signal $d_P^{B+k}(n)$ is performed by the filtering module EAk-11 by the filter $$W(z) = \frac{1-P_D(z)}{1-P_N(z)}$$

to give the filtered signal $d_{Pf}^{B+k}(n)$.

A module EAk-12 for calculating a prediction signal $Pr_Q^{B+k}(n)$ is also provided, the calculation being performed on the basis of the quantized previous samples of the quantized error signal $e_Q^{B+k}(n')n'=n-1, \ldots, n-N_D$ and of the samples of this signal filtered by $$\frac{1-P_D(z)}{1-P_N(z)}.$$

The enhancement stage EA-k also comprises a subtraction module EA-k13 for subtracting the prediction $Pr_Q^{B+k}(n)$ from the signal $d_{Pf}^{B+k}(n)$ to give a target signal $e_w^{B+k}(n)$.

The enhancement quantization module EAk-14 $Q_{Enh}^{B+k}$ performs a step of minimizing the quadratic error criterion:

$$E_j^{B+k}=[e_w^{B+k}(n)-\mathrm{enh}_{vj}^{B+k}(n)v(n)]^2\ j=0, 1$$

This module receives as input the signal $e_w^{B+k}(n)$ and provides the quantized signal $e_Q^{B+k}(n)=\mathrm{enh}_{vJ_k}^{B+k}(n)v(n)$ as first output and the index $J_k$ as second output.

The reconstructed levels of the embedded quantizer with B+k bits are calculated by splitting into two the embedded output levels of the quantizer with B+k−1 bits. Difference values between these reconstructed levels of the embedded. quantizer with B+k bits and those of the quantizer with B+k−1 bits are calculated. The difference values $\mathrm{enh}_{vj}^{B+k}(n)$ j=0, 1 are thereafter stored once and for all in processor memory and are indexed by the combination of the core quantization index and of the indices of the enhancement quantizers of the previous stages.

These difference values thus constitute a dictionary which is used by the quantization module of stage k to obtain the possible quantization values.

An addition module EAk-15 for adding the signal at the output of the quantizer $e_Q^{B+k}(n)$ to the prediction $Pr_Q^{B+k}(n)$ is also integrated into enhancement stage k as well as a module EAk-16 for adding the preceding signal to the signal reconstructed at the previous stage $r^{B+k-1}(n)$ to give the reconstructed signal at stage k, $r^{B+k}(n)$.

Just as for the coder described with reference to FIG. 8, the module Calc Mask 850 detailed previously provides the masking filter either on the basis of the input signal (FIG. 13) or on the basis of the coefficients of the ADPCM synthesis filters as explained with reference to FIG. 14.

Thus, enhancement stage k implements the following steps for a current sample:

- obtaining of a difference signal $d_P^{B+k}(n)$ by calculating the difference between the input signal x(n) of the hierarchical coding and a reconstructed signal $r^{B+k-1}(n)$ arising from an enhancement coding of a previous enhancement coding stage;
- filtering of the difference signal by a predetermined masking filter W(z);
- subtraction of the prediction signal $Pr_Q^{B+k}(n)$ from the filtered difference signal $d_{Pf}^{B+k}(n)$ to obtain the target signal $e_w^{B+k}(n)$;
- calculation of the signal at the output of the quantizer filtered by $$\frac{1-P_D(z)}{1-P_N(z)}$$

by adding the signal $Pr_Q^{B+k}(n)$ to the signal $e_Q^{B+k}(n)$ arising from the quantization step.
- calculation of the reconstructed signal $r^{B+k}(n)$ for the current sample by adding the reconstructed signal arising from the enhancement coding of the previous enhancement coding stage and the previous filtered signal.

FIG. 15 is given for a masking filter consisting of a single ARMA cell for purposes of simple explanation. It is understood that the generalization to several ARMA cells in cascade will be made in accordance with the scheme described by equations 7 to 17 and in FIGS. 9 and 10.

In the case where the masking filter comprises only one cell of the $1-P_D(z)$ type, that is to say $P_N(z)=0$, the contribution $P_D(z)E_Q^{B+k}(z)$ will be deducted from $d_{Pf}^{B+k}(n)$ or better still, the input signal of the quantizer will be given by replacing EAk-11 and EAk-13 by:

$$E^{B+k}(z)=D_P^{B+k}(z)-P_D(z)[D_P^{B+k}(z)-E_Q^{B+k}(z)]$$

It is understood that the generalization to several cells AR in cascade will be made in accordance with the scheme described by equations 7 to 17 and in FIGS. 9 and 10.

Figure 16:
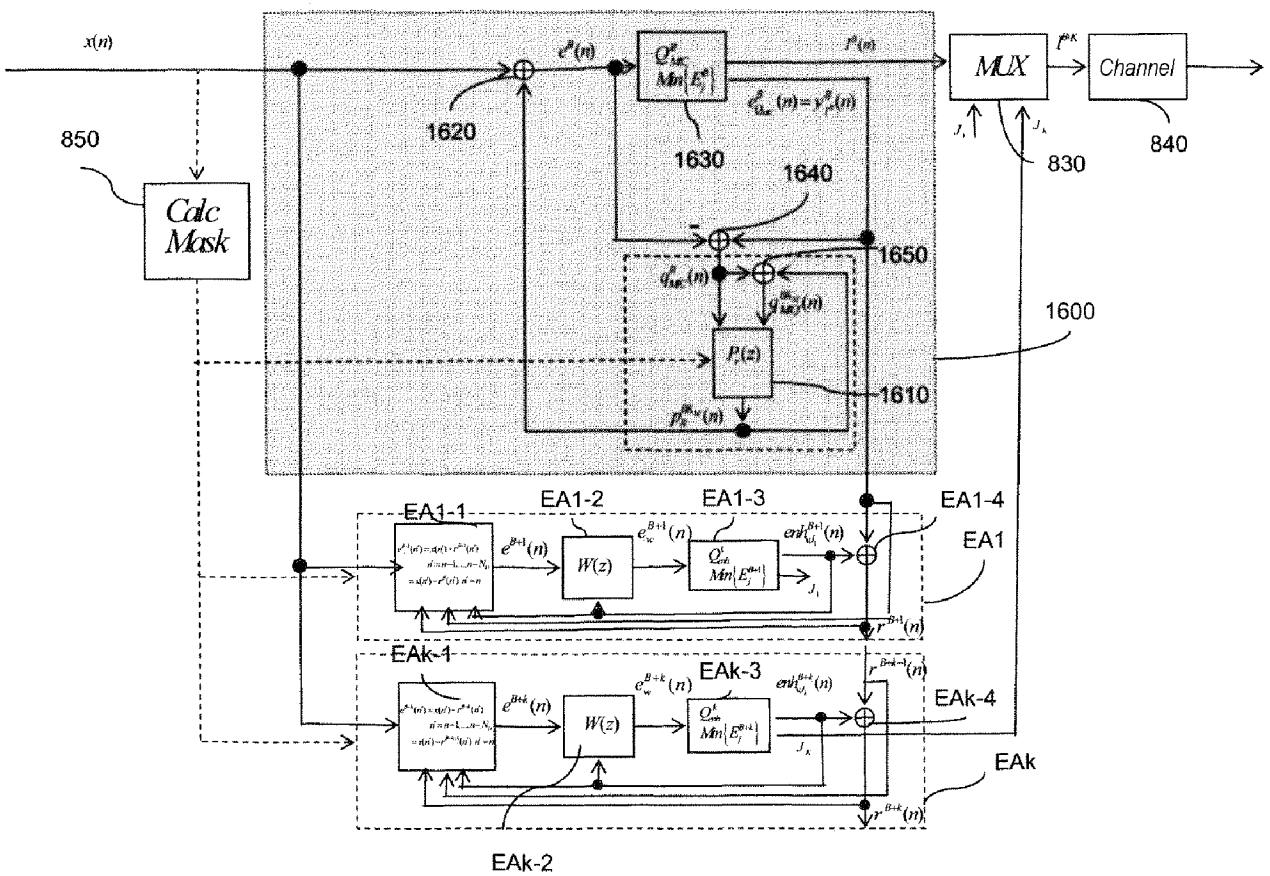
FIG. 16 represents a block diagram of a third detailed embodiment of a coder according to the invention and of a coding method according to the invention.

FIG. 16 represents a third embodiment of the invention, this time with a core coding stage of PCM type. The core coding stage 1600 comprises a shaping of the coding noise by way of a prediction module $P_r(z)$ 1610 calculating the prediction of the noise $p_R^{BK_M}(n)$ on the basis of the previous samples of the G.711 standardized PCM quantization noise $q_{MIC}^B(n')n'=n-1, \ldots, n-N_{NH}$ and of the filtered noise $q_{MICf}^{BK_M}(n')n'=n-1, \ldots, n-N_{DH}$.

Note that the noise shaping of the core coding, corresponding to the blocks 1610, 1620, 1640 and 1650 in FIG. 16, is optional. The invention such as represented in FIG. 16 applies even in respect of a PCM core coding reduced to the block 1630.

A module 1620 carries out the addition of the prediction $p_R^{BK_M}(n)$ to the input signal x(n) to obtain an error signal denoted e(n).

A core quantization module $Q_{MIC}^B$ 1630 receives as input the error signal e(n) to give quantization indices $I^B(n)$. The optimal quantization index $I^B(n)$ and the quantized value $e_{QMIC}^B(n)=y_{I^B(n)}^B(n)$minimize the error criterion $E_j^B=[e^B(n)-y_j^B(n)]^2$ $j=0, \ldots, N_Q-1$ where the values $y_j^B(n)$ are the reconstruction levels of the G.711 PCM quantizer.

By way of example, the reconstruction levels of the core quantizer $Q_{MIC}^B$ of the G.711 standard for B=8 are defined by table 1a for the A-law and table 2a for the μ-law of ITU-T recommendation G.711, "Pulse Code Modulation (PCM) of voice frequencies".

The quantization index $I^B(n)$ of B bits at the output of the quantization module $Q_{MIC}^B$ will be concatenated at 830 with the enhancement bits $J_1, \ldots, J_K$ before being transmitted via the transmission channel 840 to the standard decoder of G.711 type.

A module for calculating the quantization noise 1640, computes the difference between the input of the PCM quantizer and the quantized output $q_{QMIC}^B(n)=e_{QMIC}^B(n)-e^B(n)$.

A module for calculating the filtered quantization noise 1650 performs the addition of the quantization noise to the prediction of the quantization noise $q_{MICf}^{BK_M}(n)=q^B(n)+p_R^{BK_M}(n)$.

The enhancement coding consists in enhancing the quality of the decoded signal by successively adding quantization bits while retaining optimal shaping of the reconstruction noise for the intermediate bitrates.

Stage k, making it possible to obtain the enhancement PCM bit $J_k$ or a group of bits $J_k k=1, G_K$, is described by the block EAk.

This enhancement coding stage is similar to that described with reference to FIG. 8.

It comprises a subtraction module EAk-1 for subtracting the input signal x(n) from the signal $r^{B+k}(n)$ formed of the signal synthesized at stage k $r^{B+k}(n)$ for the samples $n-N_D, \ldots, n-1$ and of the signal synthesized at stage k−1 $r^{B+k-1}(n)$ for the instant n to give a coding error signal $e^{B+k}(n)$.

It also comprises a filtering module EAk-2 for filtering $e^{B+k}(n)$ by the weighting function W(z) equal to the inverse of the masking filter $H^M(z)$ to give a filtered signal $e_w^{B+k}(n)$.

The quantization module EAk-3 performs a minimization of the error criterion $E_j^{B+k}$ for j=0, 1 carrying out an enhancement quantization $Q_{enh}^{J_k}$ having as first output the value of the optimal PCM bit $J_k$ to be concatenated with the PCM index of the previous step $I^{B+k-1}$ and as second output $enh_{vJ_k}^{B+k}(n)$, the output signal of the enhancement quantizer fur the optimal PCM bit $J_k$.

An addition module EAk-4 for adding the quantized error signal $enh_{vJ_k}^{B+k}(n)$ to the signal synthesized at the previous step $r^{B+k-1}(n)$ gives the synthesized signal at step k $r^{B+k}(n)$. The signal $e^{B+k}(n)$ and the memories of the filter are adapted as previously described for FIGS. 6 and 8.

In the same way as that described with reference to FIG. 8 and to FIG. 15, the module 850 calculates the masking filter used both for the core coding and for the enhancement coding.

It is possible to envisage other versions of the hierarchical coder, represented in FIG. 8, 15 or 16. In a variant, the number of possible quantization values in the enhancement coding varies for each coded sample. The enhancement coding uses a variable number of hits as a function of the samples to be coded. The allocated number of enhancement bits may be adapted in accordance with a fixed or variable allocation rule. An exemplary variable allocation is given for example by the enhancement PCM coding of the low band in the ITU-T G.711.1 standard. Preferably, the allocation algorithm, if it is variable, must use information available to the remote decoder, so that no additional information needs to be transmitted, this being the case for example in the ITU-T G.711.1 standard.

Similarly, and in another variant, the number of coded samples of the enhancement signal giving the scalar quantization indices ($J_k(n)$) in the enhancement coding may be less than the number of samples of the input signal. This variant is deduced from the previous variant when the allocated number of enhancement bits is set to zero for certain samples.

Figure 17:
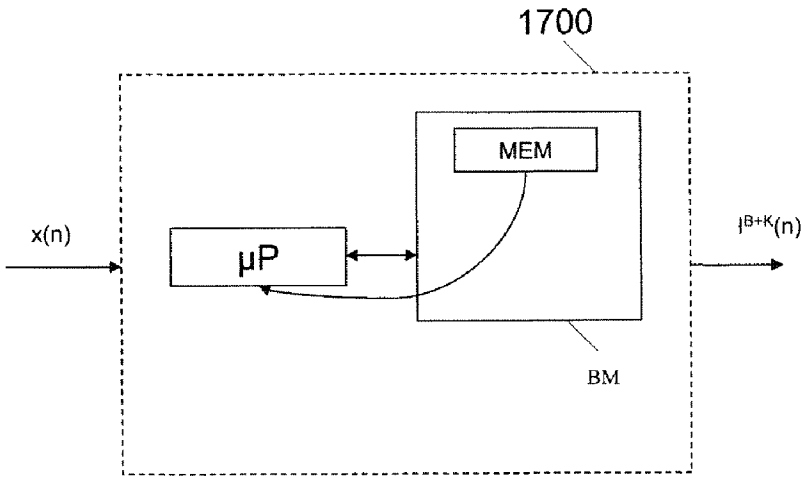
FIG. 17 represents a possible embodiment of a coder according to the invention.

An exemplary embodiment of a coder according to the invention is now described with reference to FIG. 17.

In hardware terms, a coder such as described according to the first, the second or the third embodiment within the meaning of the invention typically comprises a processor μP cooperating with a memory block BM including a storage and/or work memory, as well as an aforementioned buffer memory MEM in the guise of means for storing for example quantization values of the preceding coding stages or else a dictionary of levels of quantization reconstructions or any other data required for the implementation of the coding method such as described with reference to FIGS. 6, 8, 15 and 16. This coder receives as input successive frames of the digital signal x(n) and delivers concatenated quantization indices $I^{B|K}$.

The memory block BM can comprise a computer program comprising the code instructions for the implementation of the steps of the method according to the invention when these instructions are executed by a processor μP of the coder and especially a coding with a predetermined bitrate termed the core bitrate, delivering a scalar quantization index for each sample of the current frame and at least one enhancement coding delivering scalar quantization indices for each coded sample of an enhancement signal. This enhancement coding comprises a step of obtaining a filter for shaping the coding noise used to determine a target signal. The indices of scalar quantization of said enhancement signal are determined by minimizing the error between a set of possible values of scalar quantization and said target signal.

More generally, a storage means, readable by a computer or a processor, which may or may not be integrated with the coder, optionally removable, stores a computer program implementing a coding method according to the invention.

FIGS. 8, 15 or 16 can for example illustrate the algorithm of such a computer program.

The invention claimed is:

1. A method of hierarchical coding of a digital audio signal comprising, for a current frame of the input signal:

performing, on a processor, a core coding, delivering a scalar quantization index for each sample of the current frame to at least one enhancement coding layer; and performing, on the processor, at least one enhancement coding delivering indices of scalar quantization for each coded sample of an enhancement signal, wherein the enhancement coding comprises a step of obtaining an enhancement coding error signal by combining the input signal of the hierarchical coding with a signal reconstructed partially based on a coding of a previous coding layer and of the past samples of the reconstructed signals of the current enhancement coding layer, and a step of obtaining a noise shaping filter and filtering the enhancement coding error signal with this noise shaping filter to determine a target signal and the indices of scalar quantization of said enhancement signal are determined by minimizing error between a set of possible values of scalar quantization for each sample of the current frame and said target signal, wherein the noise shaping filter is further modified by adapting memories of the noise shaping filter based on the output of the scalar quantization step corresponding to the determined indices of scalar quantization for each coded sample of the enhancement signal.

2. The method as claimed in claim 1, wherein it further comprises the following step for a current sample:

calculating the reconstructed signal for the current sample by addition of the reconstructed signal arising from the coding of a previous coding layer and of the signal arising from the enhancement quantization step.

3. The method as claimed in claim 1, wherein the set of the possible scalar quantization values and the quantization value of the enhancement coding error signal for the current sample are values denoting quantization reconstruction levels, scaled by a level control parameter calculated with respect to the core bitrate quantization indices.

4. The method as claimed in claim 3, wherein the values denoting quantization reconstruction levels for an enhancement stage k are defined by the difference between the values denoting the reconstruction levels of the quantization of an embedded quantizer with B+k bits, B denoting the number of bits of the core coding and the values denoting the quantization reconstruction levels of an embedded quantizer with B+k−1 bits, the reconstruction levels of the embedded quantizer with B+k bits being defined by splitting the reconstruction levels of the embedded quantizer with B+k−1 bits into two.

5. The method as claimed in claim 4, wherein the values denoting quantization reconstruction levels for the enhancement layer k are stored in a memory space and indexed as a function of the core bitrate quantization and enhancement indices.

6. The method as claimed in claim 1, wherein the number of possible values of scalar quantization varies for each sample.

7. The method as claimed in claim 1, wherein the number of coded samples of said enhancement signal, giving the scalar quantization indices, is less than the number of samples of the input signal.

8. The method as claimed in claim 1, wherein the core coding layer is an ADPCM coding layer using a scalar quantization and a prediction filter.

9. The method as claimed in claim 1, wherein the core coding layer is a PCM coding layer.

10. The method as claimed in claim 8, wherein the core coding further comprises the following steps for a current sample: obtaining a prediction signal for the coding noise based on past quantization noise samples and based on past samples of quantization noise filtered by a predetermined noise shaping filter; and combining the input signal of the core coding layer and the coding noise prediction signal so as to obtain a modified input signal to be quantized.

11. The method as claimed in claim 10, wherein said noise shaping filter used by the enhancement coding layer is also used by the core coding layer.

12. The method as claimed in claim 1, wherein the noise shaping filter is calculated as a function of said input signal.

13. The method as claimed in claim 1, wherein the noise shaping filter is calculated based on a signal locally decoded by the core coding layer.

14. The method as claimed in claim 9, wherein the core coding further comprises the following steps for a current sample:

obtaining a prediction signal for the coding noise based on past quantization noise samples and based on past samples of quantization noise filtered by a predetermined noise shaping filter; and combining the input signal of the core coding and the coding noise prediction signal so as to obtain a modified input signal to be quantized.

15. The method as claimed in claim 10, wherein the noise shaping filter is calculated as a function of said input signal.

16. The method as claimed in claim 10, wherein the noise shaping filter is calculated based on a signal locally decoded by the core coding.

17. The method as claimed in claim 14, wherein said noise shaping filter used by the enhancement coding is also used by the core coding.

18. The method as claimed in claim 14, wherein the noise shaping filter is calculated as a function of said input signal.

19. The method as claimed in claim 14, wherein the noise shaping filter is calculated based on a signal locally decoded by the core coding.

20. A hierarchical coder of a digital audio signal for a current frame of the input signal comprising:

a core coding module; and at least one enhancement coding module, wherein the core coding module delivers a scalar quantization index for each sample of the current frame to the at least one enhancement coding module;

wherein the at least one enhancement coding module delivers indices of scalar quantization for each coded sample of an enhancement signal, wherein the enhancement coding module comprises a module for obtaining an enhancement coding error signal by combining the input signal of the hierarchical coder with a signal reconstructed partially based on a coding of a previous coding layer and of the past samples of the reconstructed signals of the current enhancement coding module, a module for obtaining a noise shaping filter, a module for filtering the enhancement coding error signal with this noise shaping to determine a target signal and a quantization module delivering the indices of scalar quantization of said enhancement signal by minimizing the error between a set of possible values of scalar quantization and said target signal, and wherein the noise shaping filter is further modified by adapting memories of the noise shaping filter based on the output of the scalar quantization step corresponding to the determined indices of scalar quantization for each coded sample of the enhancement signal.

21. A non-transitory computer program product comprising code instructions for the implementation of the steps of the coding method as claimed in claim 1, when these instructions are executed by a processor.

* * * * *